US006744372B1

(12) United States Patent
Shaw et al.

(10) Patent No.: US 6,744,372 B1
(45) Date of Patent: Jun. 1, 2004

(54) CRANE SAFETY DEVICES AND METHODS

(76) Inventors: Jack B. Shaw, 2710 Bedford St., Johnstown, PA (US) 15904; John B. Shaw, Jr., 822 Olim St., Johnstown, PA (US) 15904

( * ) Notice: Subject to any disclaimer, the term of this patent is extended or adjusted under 35 U.S.C. 154(b) by 0 days.

(21) Appl. No.: 09/447,812

(22) Filed: Nov. 23, 1999

Related U.S. Application Data

(63) Continuation-in-part of application No. 09/383,192, filed on Aug. 26, 1999, now Pat. No. 6,549,139, which is a continuation of application No. PCT/US98/03482, filed on Feb. 26, 1998, which is a continuation-in-part of application No. 09/030,249, filed on Feb. 25, 1998, now Pat. No. 6,140,930.

(60) Provisional application No. 60/039,825, filed on Feb. 27, 1997.

(51) Int. Cl.[7] ..... G08B 21/00

(52) U.S. Cl. ..... 340/685; 212/276; 701/50

(58) Field of Search ..... 340/685, 679, 340/686, 680, 668, 683, 669, 670, 671, 673, 677, 691.1, 692, 425.5, 431, 436, 438, 463, 467, 468, 474; 212/276, 277, 279; 701/50

(56) References Cited

U.S. PATENT DOCUMENTS

| | | | | |
|---|---|---|---|---|
| 3,693,360 A | * | 9/1972 | Holder | 61/46 |
| 3,815,116 A | | 6/1974 | Fink | |
| 3,823,395 A | | 7/1974 | Rigney et al. | |
| 3,848,750 A | | 11/1974 | Hoge | |
| 3,969,714 A | | 7/1976 | Greer | |
| 4,178,591 A | | 12/1979 | Geppert | |
| 4,183,708 A | | 1/1980 | Kuhbier et al. | |
| 4,236,864 A | | 12/1980 | Couture et al. | |
| 4,238,037 A | | 12/1980 | Azovtsev et al. | |
| 4,281,342 A | * | 7/1981 | Ueda | 358/93 |
| 4,300,134 A | | 11/1981 | Paciorek | |
| 4,303,973 A | | 12/1981 | Williamson, Jr. et al. | |
| 4,424,909 A | | 1/1984 | Bergeron | |
| 4,454,757 A | * | 6/1984 | Weinstein | 73/189 |
| 4,516,117 A | | 5/1985 | Couture et al. | |
| 4,735,526 A | * | 4/1988 | Kawagoe et al. | 405/196 |
| 4,752,012 A | | 6/1988 | Juergens | |

(List continued on next page.)

FOREIGN PATENT DOCUMENTS

| | | | |
|---|---|---|---|
| EP | 0008210 A1 | | 2/1980 |
| EP | 0 072 567 A2 | | 2/1983 |
| EP | 0614845 A2 | | 9/1994 |
| FR | 76 05946 | | 9/1977 |
| GB | 2050294 A | | 1/1981 |
| JP | 58-42600 | | 3/1983 |
| JP | 405085250 | * | 4/1993 |
| JP | 07-81887 | | 3/1995 |
| JP | 8-324965 | | 12/1996 |
| JP | 408324965 | * | 12/1996 |
| NL | 8503113 | | 6/1987 |
| RU | XP-002182910 | | 8/1981 |
| WO | 85/05614 | | 12/1985 |
| WO | WO 98/55388 | | 12/1998 |

OTHER PUBLICATIONS

James R. Guenther, "Interpretation on standards for use of cranes during high wind condition", Mar. 26, 1985, OSHA Occupational Safety & Health Administration U.S. Department of Labor, pp. 1–4.*

U.S. Department of Labor, Occupational Safety and Health Administration. Regulations (Standards—29 CFR), Cranes and derricks–1917.45 (17 pages).

*Primary Examiner*—Brent A. Swarthout
(74) *Attorney, Agent, or Firm*—Banner & Witcoff, Ltd.

(57) ABSTRACT

An improved crane warning system which includes acceleration sensors, motion sensors, hydraulic sensors, remote communications and/or a camera. The crane warning system may include a crane warning device integrated into the ball of the crane.

13 Claims, 16 Drawing Sheets

U.S. PATENT DOCUMENTS 4,788,534 A * 11/1988 Engelhardt ..... 340/601
4,833,615 A * 5/1989 Bitner ..... 363/463
4,849,778 A 7/1989 Samuelson
4,896,370 A 1/1990 Kasparian et al.
5,019,798 A 5/1991 Pherigo, Jr.
5,042,959 A 8/1991 Tadatsu
5,058,752 A 10/1991 Wacht et al.
5,067,013 A 11/1991 Lindholm et al.
5,089,972 A 2/1992 Nachman et al.
5,152,408 A 10/1992 Tax et al.
5,198,800 A 3/1993 Tozawa et al.
5,211,245 A 5/1993 Relyea et al.
5,217,126 A 6/1993 Hayashi et al.
5,220,499 A 6/1993 Kawamori
5,353,400 A 10/1994 Nigawara et al.
5,371,895 A 12/1994 Bristol
5,392,935 A * 2/1995 Kazama ..... 212/155
5,400,246 A 3/1995 Wilson et al.
5,485,620 A 1/1996 Sadre et al.
5,504,880 A 4/1996 Hirosawa et al.
5,506,787 A 4/1996 Muhlfeld et al.
5,517,404 A 5/1996 Biber et al.
5,526,268 A 6/1996 Tkacs et al.
5,537,605 A 7/1996 Teece
5,539,650 A 7/1996 Hehl
5,594,858 A 1/1997 Blevins
5,646,343 A * 7/1997 Pritchard ..... 73/170.08
5,729,453 A * 3/1998 Lee ..... 364/424.07
5,823,370 A * 10/1998 Ueda ..... 212/276
6,140,930 A 10/2000 Shaw
6,549,139 B2 * 4/2003 Shaw, Jr. ..... 340/685

* cited by examiner 56
60
58
61
59
62
S
N
E
63
64
5
65

CRANE SAFETY DEVICES AND METHODS

RELATED APPLICATIONS

This application is a continuation-in-part of U.S. Pat. application Ser. No. 09/383,192, entitled "Crane Safety Devices and Methods," filed Aug. 26, 1999, now U.S. Pat. No. 6,549,139 which is a continuation application of co-pending International Application No. PCT/US98/03482, entitled "Crane Safety Devices and Methods," filed Feb. 26, 1998, which is a continuation-in-part of U.S. patent application Ser. No. 09/030,249, entitled "Crane Safety Devices and Methods," filed Feb. 25, 1998, now U.S. Pat. No. 6,140,930 which is based on U.S. Provisional Application Serial No. 60/039,825, entitled "Crane Safety Devices and Methods," filed Feb. 27, 1997, now abandoned, which are all hereby incorporated by reference in their entireties.

TECHNICAL FIELD

The present invention relates to crane safety methods and devices and, in particular, to improved safety devices and methods which warn workers of the movement of portions of a crane. The invention also relates to a system for safely controlling the operation of crane in response to prevailing wind conditions.

BACKGROUND OF THE INVENTION

Conventional crane safety devices (e.g., U.S. Pat. No. 5,019,798) are subject to a number of deficiencies. For example, the devices must be manually attached to the load each time that a new load is secured to the crane. Further, a warning beacon on the safety device often becomes obscured by the load, especially where the load is large or of an unusual shape. Further, the warning indicators on the device are always active whether or not the load is actually in motion. This condition is dangerous because it does not sufficiently warn the workman when the ball is in motion. Because of these disadvantages, crane safety devices mounted proximate to the moving crane parts have not been widely utilized. Moreover, conventional crane safety devices do not inform the operator of the prevailing wind conditions proximal to the crane. Having this information is important for the safe operation of the crane, however, as the wind speed, direction of the crane boom relative to the wind, and boom length all will affect the wind load of the boom. Accordingly, there is a need for an improved crane safety device that provides wind information to the crane operator.

There is also a need to provide the crane operator with a control system and corresponding display for better controlling the operation and/or configuration of the crane. Conventional crane control systems, such as that disclosed in U.S. Pat. No. 5,731,974, employ a sequential decision tree for controlling the configuration of the crane. That is, the crane operator must control each configuration step in sequential order. To change a previously-made configuration (e.g., boom length), the operator must repeat or verify all of the control operations preceding the desired control operation relating to boom length. Accordingly, there is a need for a crane control system that permits a crane operator to execute control operations in any convenient order, or even simultaneously.

SUMMARY OF THE INVENTION

One aspect of the invention is to provide an acceleration sensor within the crane warning device which activates the crane warning device whenever the ball of the crane is being accelerated in any direction. For example, a mercury switch, a piezo-electric sensor, or other conventional acceleration sensor may be utilized to determine when the ball of the crane is accelerating.

Another aspect of the invention is to include a sensor which detects constant velocity motion of the ball of the crane. This sensor may be utilized in addition to or instead of the acceleration detector coupled to the ball of the crane. The motion sensor may be wholly contained within a housing of the warning device or it may be distributed at other locations in the crane such as by coupling portions of the warning device to one or more other electromechanical components of the crane. In one aspect of the invention, portions of the motion sensor are coupled to one or more hydraulic systems in the crane and actuated appropriately whenever the hydraulic system is actuated to move the ball of the crane. In yet other aspects of the invention, portions of the motions sensor are coupled to the electronic control system of the crane. In still other aspects of the invention, the mechanisms for detecting motion are mounted remotely and communicate with the warning device using electromagnetic waves such as radio waves.

In yet other aspects of the invention, fail-safe mechanisms may be built into the crane warning device such that the warning device is activated whenever a sensor fails or looses contact (e.g., radio contact) with the warning device. Further, a crane warning device status monitor may be built into the cabin of the crane so that the operator may be warned of any operational problems with any of the sensors in a timely fashion.

In still further aspects of the invention, the crane warning device may be mounted to maximize its utilization and resulting safety such as by integrating the crane warning device directly into the ball of the crane. In still further aspects, the warning device may be removably or fixedly attached to the side of the crane (e.g., by bolting or magnetically attaching the device to one or more sides of the counter weight).

In still further aspects of the invention, multiple crane warning devices are coupled to the crane in different locations so as to maximize safety. For example, one crane warning device may be located on the ball, and second, third, and/or fourth crane warning devices respectively mounted on first, second, and third sides of the crane counter weight. In yet other aspects of the invention, the audible and visual warning indicators from all of the crane warning devices may be synchronized such that the beep noise and/or the strobe light from all of the crane warning devices are coincident.

In still further aspects of the invention, a microphone and speaker system is included in the crane warning device such that the operator can communicate with the workers. Worker safety is vastly increased because the worker may use both hands to manipulate the load while verbally signaling the operator. In further aspects of the invention, the a camera may be mounted such that a birds eye view of the load/ball may be obtained by the operator sitting in the cab from a remotely mounted camera. The birds eye view, alone or in conjunction with the audio communications, vastly increases safety and efficiency of the crane operating environment. Additionally, in other aspects of the invention, electronics in the warning device may electronically filter the noise from the crane audible warning device so as not to interfere with normal communication with the crane operator. The filtering eliminates the beeping emitted from the warning device without filtering out the normal voice of the operator and/or worker. In still further aspects of the invention, the crane warning devices are mounted on different sides of the crane so that the operator has immediate communications with all sides of the crane, further enhancing safety.

Yet another aspect of the invention is to provide a crane control apparatus that includes at least one wind sensor to collect information concerning wind proximal to the crane, and a display system for display the wind information gathered by the wind sensor. Preferably, the wind sensor detects both the speed and direction of the wind, and can provide the crane operator with direction of the crane boom relative to the wind direction. According to other aspects of the invention, the crane control apparatus includes a control console for controlling the configuration of the crane in response to the wind information provided by the wind sensor. Also, with further aspects of the invention, a plurality of wind sensors is mounted along the length of the boom.

Still yet another aspect of the invention is to provide a crane control apparatus that includes at least one wind sensor to collect information concerning wind proximal to the crane, a display system for display the wind information gathered by the wind sensor, and a boom length detector for displaying a detected length of the crane's boom. In addition to providing both the speed and direction of the wind, and the invention also provides the crane operator with the wind load for the crane. According to other aspects of the invention, the crane control apparatus includes a control console for controlling the configuration of the crane in response to the wind and wind load information provided by the wind sensor and the boom length detector.

A further aspect of the invention is to provide a control system for a crane that includes a display and a control console. The control system generates a decision network for controlling operation of the crane, receives input data from a crane operator regarding selected nodes of the network, and configures the crane according to the input data.

Although the invention has been defined using the appended claims, these claims are exemplary and not limiting in that the invention is meant to include one or more elements from the apparatus and methods described herein in any combination or subcombination. Accordingly, there are any number of alternative combinations for defining the invention, which incorporate one or more elements from the specification (including the drawings) in various combinations or subcombinations.

DESCRIPTION OF PREFERRED EMBODIMENTS

Figure 1:
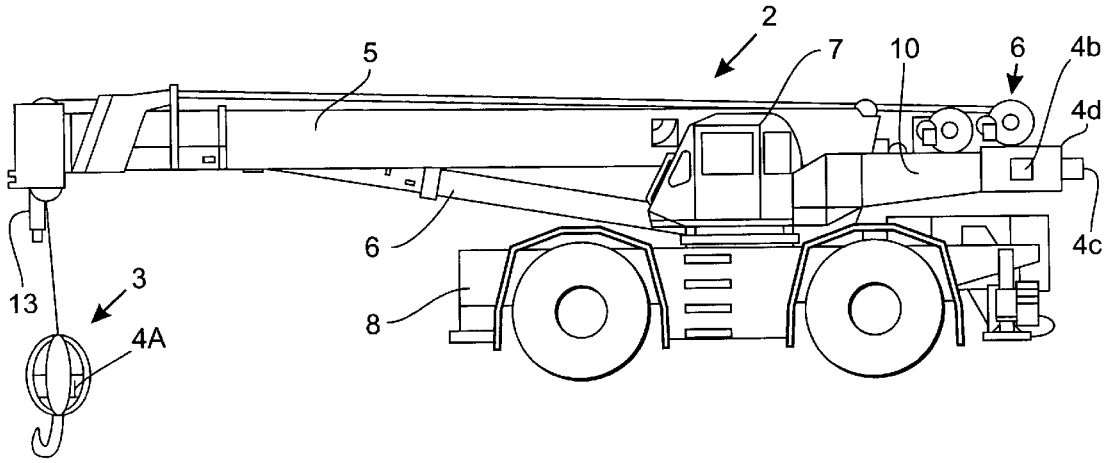
FIG. 1 is a perspective view of a crane incorporating aspects of the crane warning system.
Figure 2:
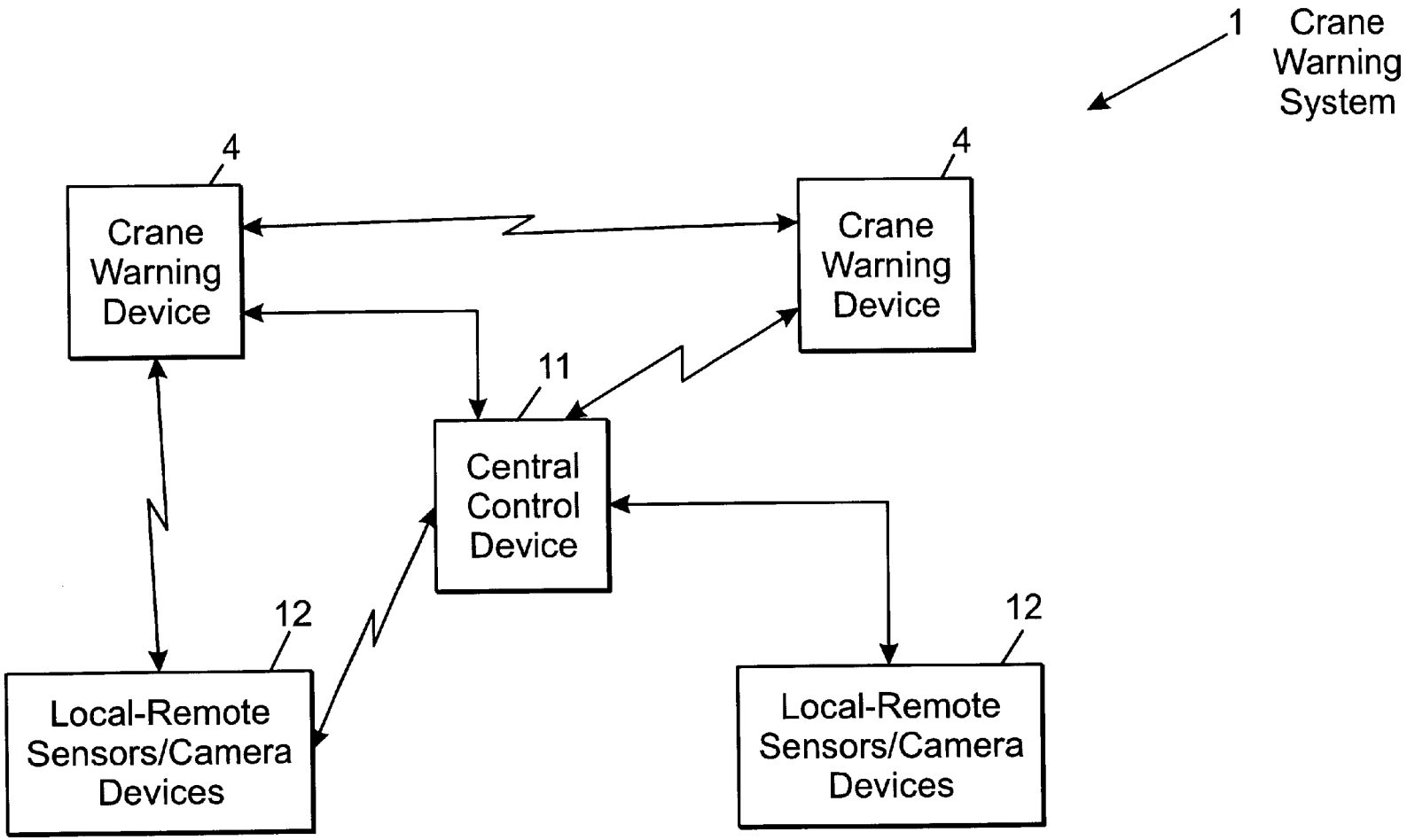
FIG. 2 is a block diagram of a crane warning system incorporating a plurality of crane warning devices, a central control device, and a plurality of remote sensors.

Referring to FIGS. 1 and 2, a crane warning system 1 is incorporated in a crane 2 to improve the safety of workers (not shown) in the vicinity of the crane. The crane 2 typically includes a boom 5, various movement mechanisms 6 to move the boom 5, carriage (not shown in the embodiment of FIG. 1), and/or ball 3 in any one of a plurality of directions. The movement mechanisms may include any hydraulic, electromotive, mechanical, and/or other mechanisms well known in the art to cause motion of the ball 3, boom 5, and/or carriage (not shown). For the purposes of this specification, the boom includes any jib or other extension that may be attached to the boom. The crane 2 typically includes a cab 7 for accommodating an operator (not shown). In many cases, the cab 7 is either partially or completely enclosed to provide a controlled environment for the operator. The crane 2 may include one or more crane warning devices 4 strategically disposed about the crane 2. In the embodiment shown in FIG. 1, the crane warning device 4A is incorporated directly into the ball 3 of the crane 2. Alternatively, the crane warning device 4 may be located at other strategic locations such as on the counter weight 10. In the embodiment illustrated in FIG. 1, there are three crane warning devices 4 located on three different sides of the counter weight 10.

Disposing a crane warning device on the crane counter weight is particularly advantageous where the crane is used in an urban area. Often the crane is positioned in the street adjacent to the sidewalk. Pedestrians are often routed around the crane using orange warning cones. However, in order to keep from being injured by cars, pedestrians often stand within the cones while waiting for cars to pass. These pedestrians are often oblivious to the fact that when the crane turns, a large counter weight also swings out into the street where they are standing. Thus, the crane warning devices 4 disposed on the counter weight 10 are particularly advantageous. The crane warning device 4 may be located directly on the counter weight using any suitable method such as bolting, strapping, or magnetic attachment. The crane warning device 4 may also be mounted toward the back of the counter weight so as to be near the portion of the counter weight which extends furthermost from the crane as the counter weight turns.

Referring specifically to FIG. 2, one or more of the crane warning devices 4 may operate in isolation or may be coupled to one or more other devices. Where the crane warning devices 4 are coupled to other devices, they may be coupled to a central control device 11, one or more other crane warning devices 4, and/or one or more remote sensors/camera units 12. Where a central control device 11 is utilized, the central control device 11 may be directly or indirectly coupled to one or more remote sensors and/or camera units 12. The connections between the crane warning devices 4, the central control device I 1, and remote sensors and/or camera units 12, 13 may be accomplished using any suitable mechanism such as electromagnetic transmission (e.g., radio waves) and/or direct electrical and/or optical connections.

Where a remote camera 13 is utilized, the remote camera may be mounted in any suitable location such as on the boom, ball, cable, carriage, etc. In many embodiments, the remote camera 13 may be mounted such that a birds eye view is presented to the operator in the cab such that the operator can see all around the load and is not restricted to viewing only one side of the load. In this manner, where the worker stands on the far side of the load, the operator can view the workers actions and position relative to the load. The camera 12, 13 may be equipped with a zoom lens to zoom-in on the work area which may be either remote controlled and/or controlled based on the current location of the ball. In other words, the zoom lens may be adjusted such that the zoom feature tracks the current location of the ball with little zoom where the ball is close to the boom and increased zoom where the ball is remote from the boom. The remote camera 12, 13 may also be equipped with a laser range finder that determines the location of the ground level relative to the boom and relays this information back to a central controller. The controller may cause the raising and lowering of the ball to be at a rapid rate until the ball approaches the ground or target level and then automatically slow the decent. Similarly, the range finder may be positioned directly over the ball and be directed at the ball where a second range finder is directed to the side of the ball at the ground or target location so that the controller is able to determine the relative distance between the ball and the ground or target location.

Figure 4:
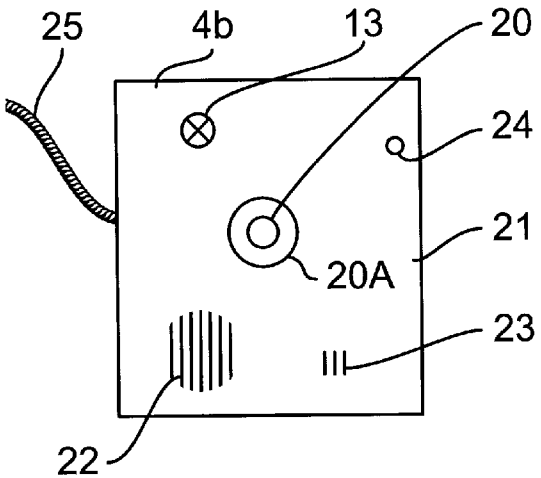
FIGS. 3–5 are perspective views of first, second, and third embodiments of a crane warning devices incorporating aspects of the present inventions.
Figure 3:
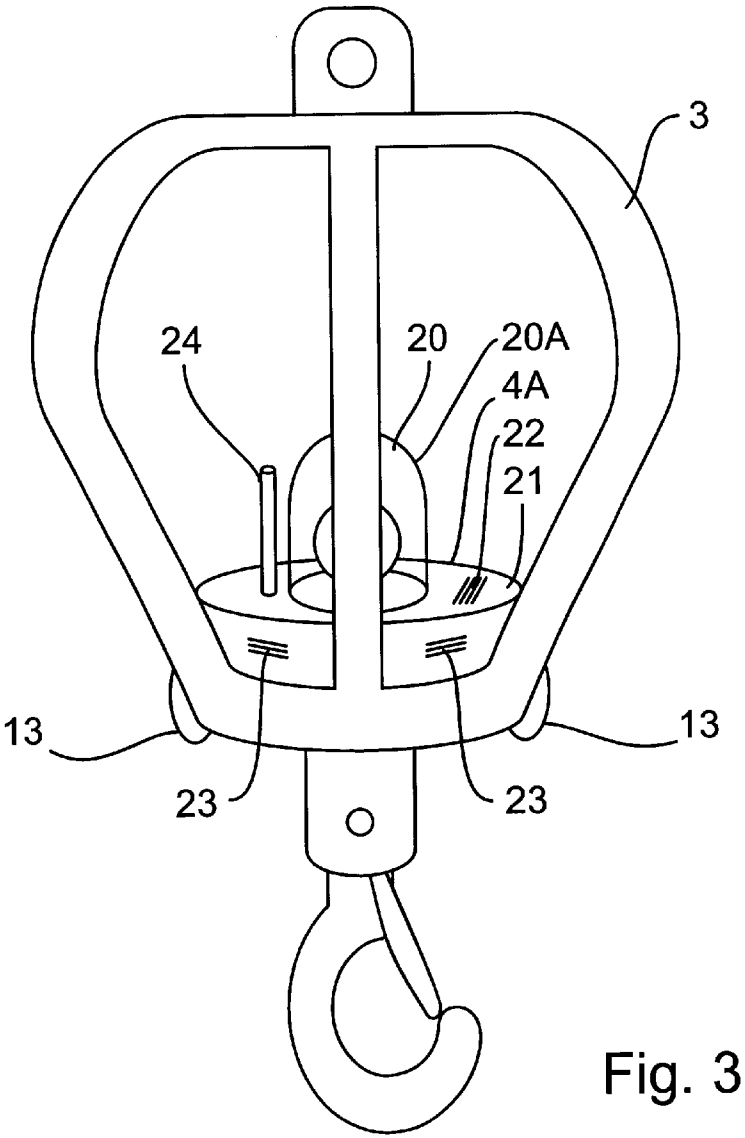
Figure 5:
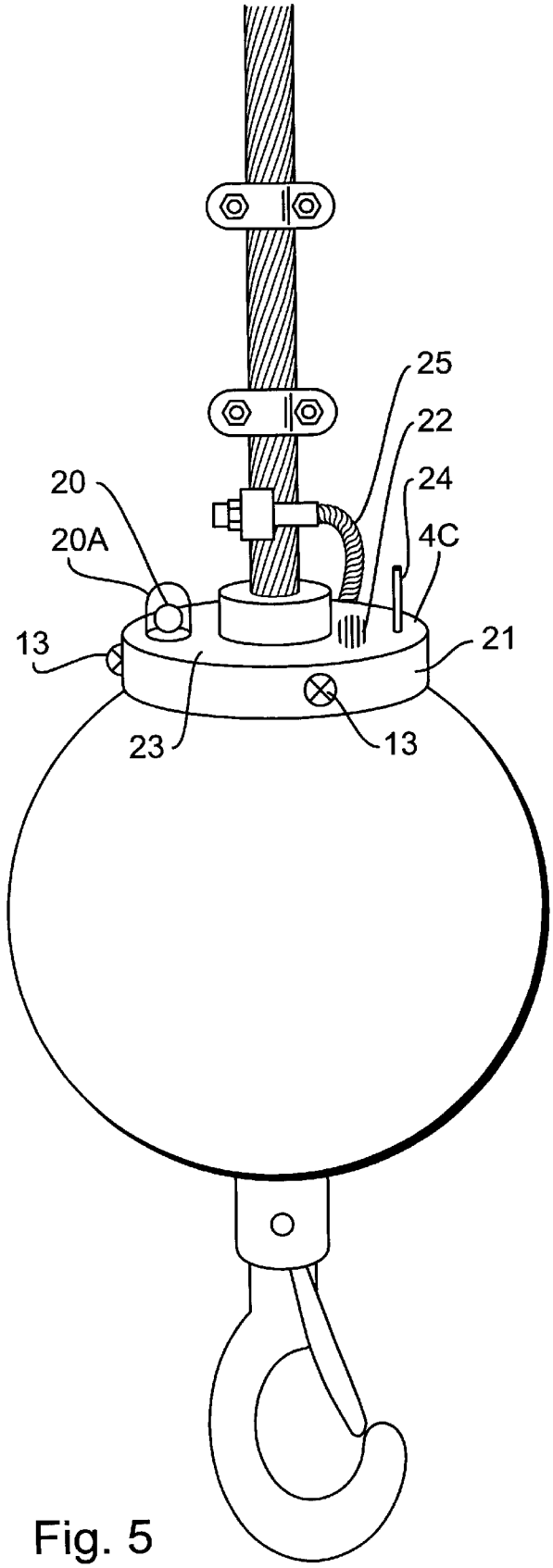

Referring to FIGS. 3–5, three different embodiments of the crane warning device 4 are shown. The crane warning devices 4A, 4B, and 4C may include a beacon light 20, one or more audible warning devices 22 (speakers), one or more audio processor devices 23 (microphones), a transmit/receive mechanism 24 (antenna), a tether 25, and/or one or more remote sensor/camera devices 13 coupled to an enclosure 21. With regard to FIG. 3, the crane warning device 4A is incorporated directly into the ball 3 of the crane 2. Where the crane warning device is integrated into the ball of the crane, visibility of the warning light is maximized and a centralized audible warning noise is advantageously provided to minimize interference of the load with the warning device. When integrated into the ball, the warning device remains visible from substantially all angles, e.g., 360 degrees. With regard to FIG. 4, the crane warning device may be incorporated in an enclosure 21 and mounted about the crane such as on one or more sides of the counterweight 10. In the embodiment of FIG. 5, the crane warning device may be positioned above the ball 3. In the embodiments of FIGS. 4 and 5, it may be desirable to incorporate a magnet into the base of the crane warning device to facilitate attachment to the ball or counterweight of the crane. In this manner, it is a simple task to retrofit cranes with a suitable crane warning device.

Figure 6:
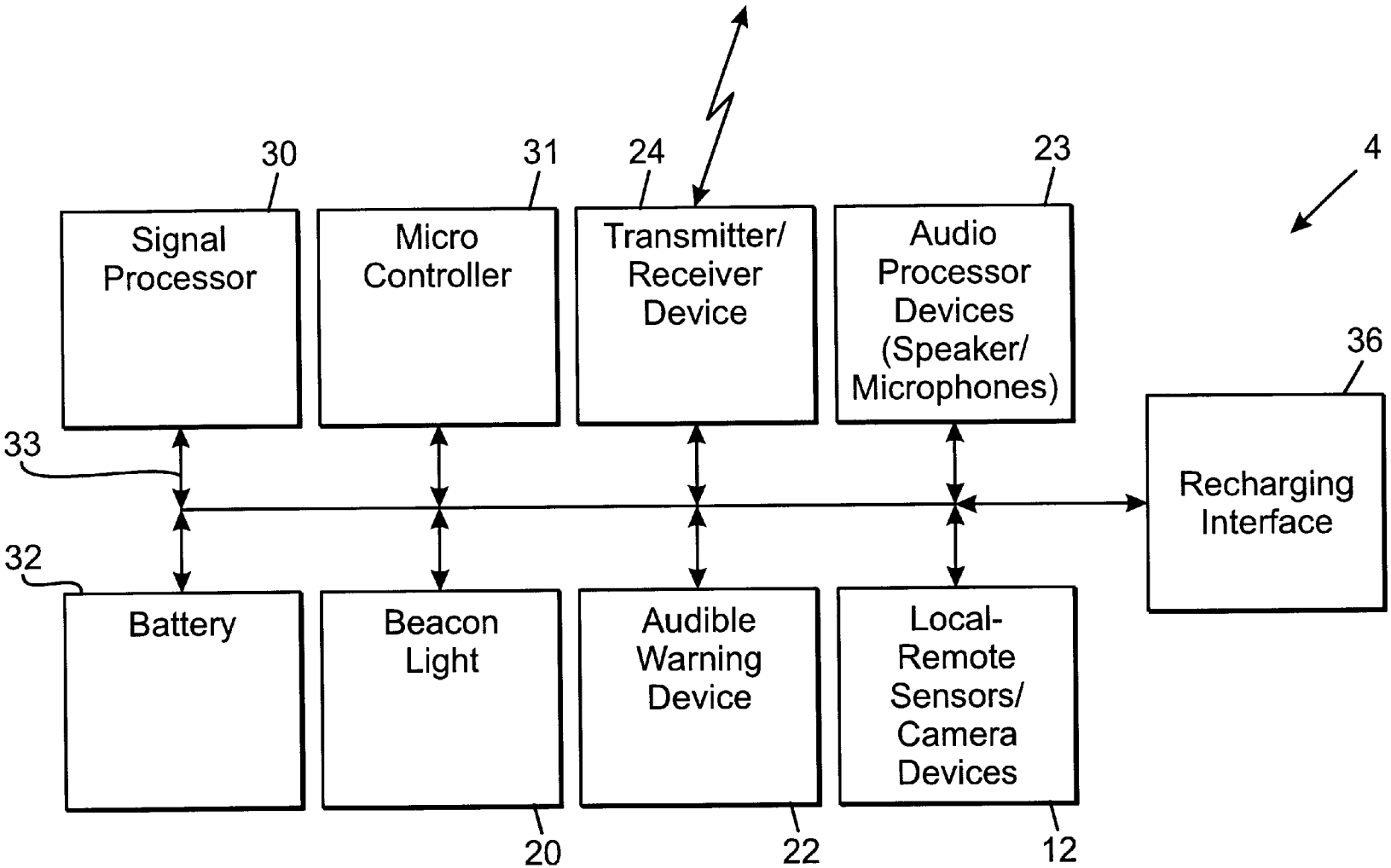
FIG. 6 is a block diagram of an embodiment of the crane warning device.
Figure 7:
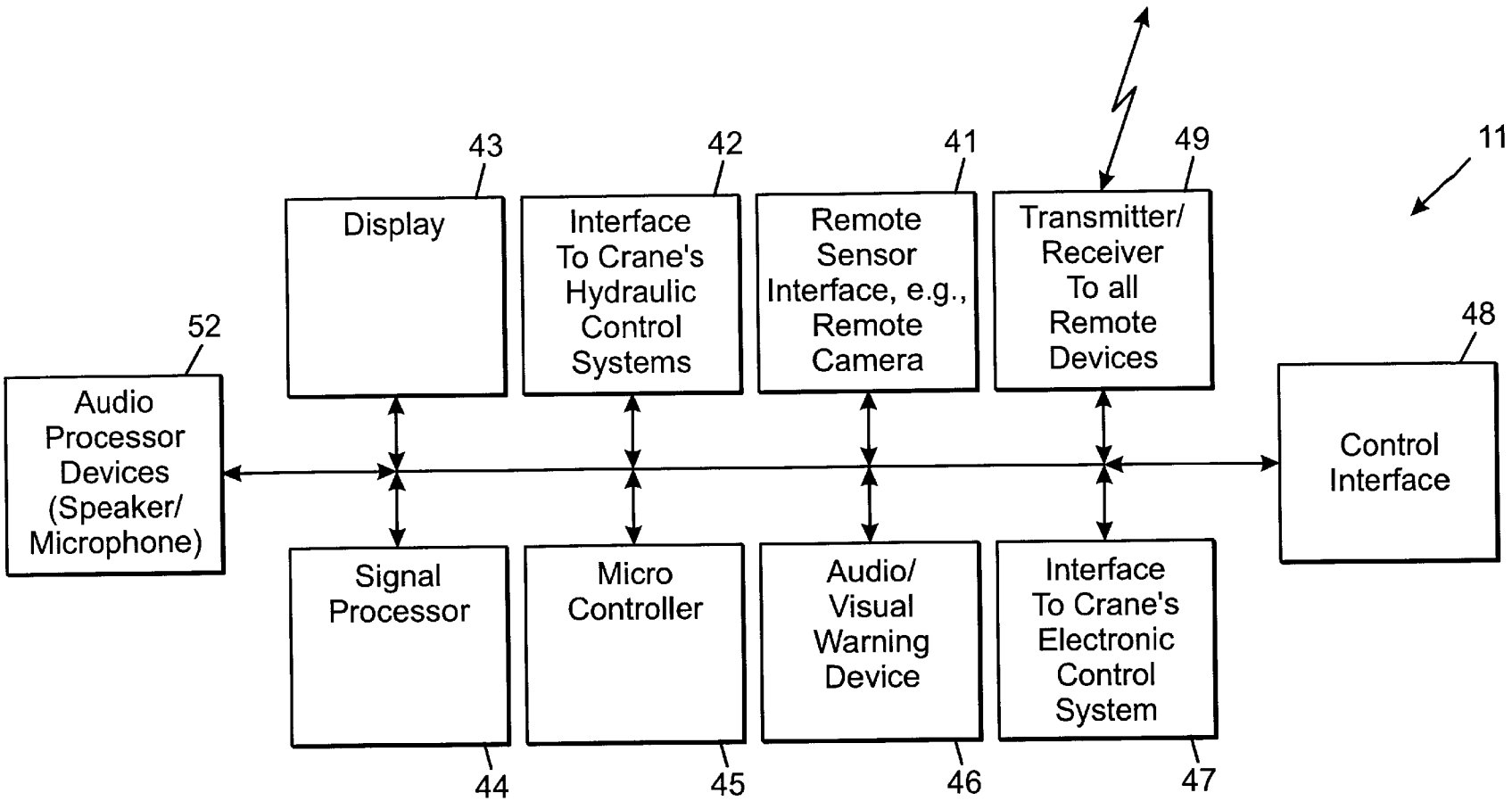
FIG. 7 is a block diagram of a central control device.
Figure 8:
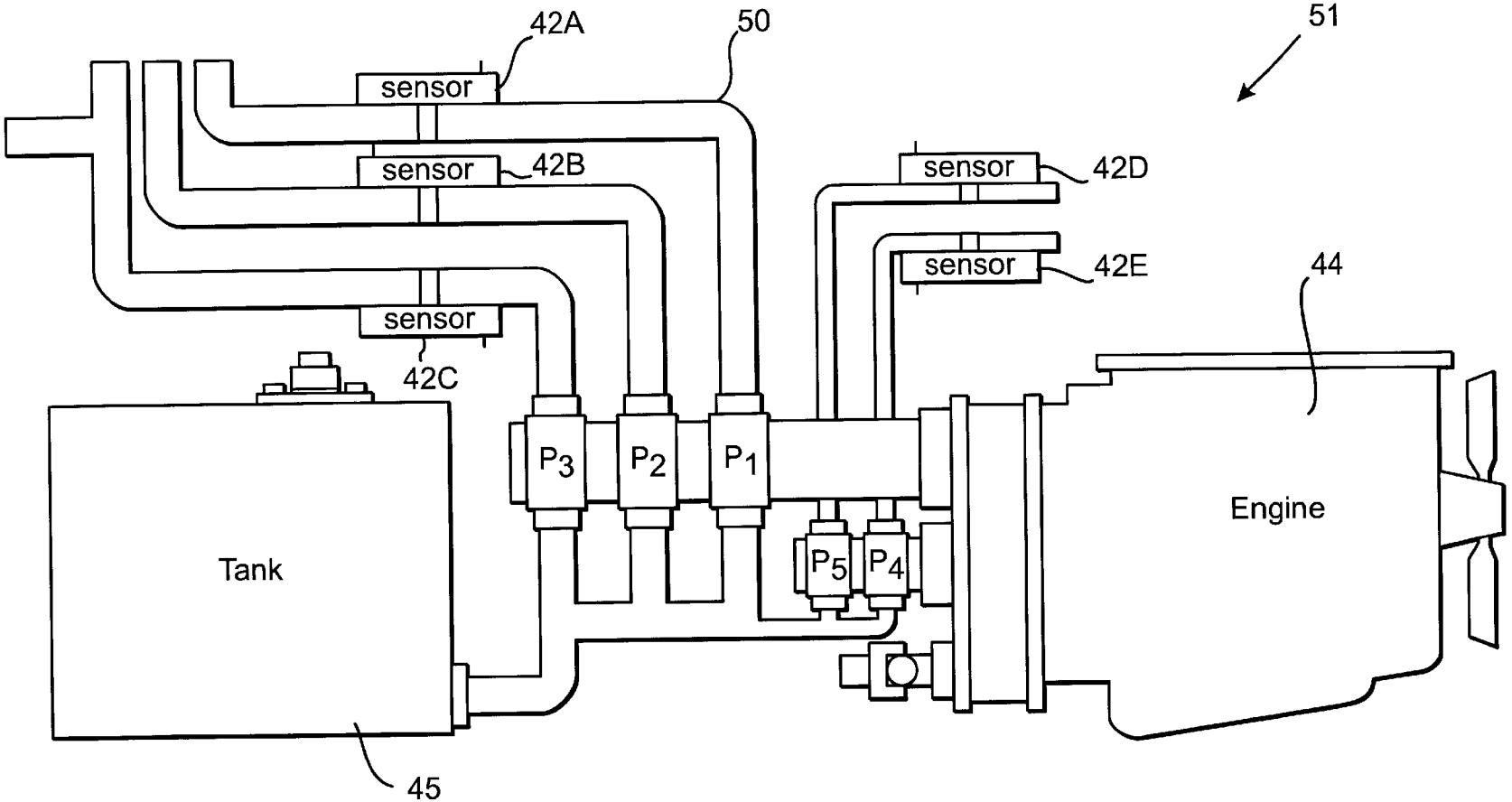
FIG. 8 is a partial schematic, partial block diagram of a remote sensor arrangement coupled to a hydraulic system in the crane.

Referring to FIG. 6, an exemplary block diagram of one embodiment of the crane warning device 4 is shown. The crane warning device may include the beacon light 20, the audible warning device 22, the local and/or remote sensors/camera device 12, 13, audio processor devices 23, transmitter/receiver device 24, a signal processor 30, a microcontroller 31, a recharging interface 36, and a battery 32 interconnected via one or more system busses 33. FIG. 7 shows an exemplary block diagram of one embodiment of the central control device 11. The central control device 11 may include a signal processor 44, a microcontroller 45, an audio/visual warning device 46, an interface to the crane's electronic control system 47, a control interface 48, a transmitter/receiver 49, a remote sensor interface 41, a hydraulic control interface 42, and a display 43. FIG. 8 shows an exemplary embodiment of the hydraulic system 51 of the crane 2 where hydraulic sensors 42A–42E are coupled to a hydraulic system incorporating a tank 45, a plurality of pumps P1–P6, an engine 44, and a plurality of hydraulic lines 50. The crane warning devices 4 and the central control device 11 may be variously configured to include any subset of the devices shown in the block diagrams or FIGS. 1–14 in any subcombination.

The beacon light 20 may be any suitable configuration including a flashing light or a strobe light. In some embodiments, the beacon light 20 may include a protective cover 20A made of a high impact polymer such as a plastic resin. Further, the protective cover 20A or the beacon light 20 may be colored so as to emit a red or orange light. In preferred embodiments, the output of the beacon light 20 is controlled such that the beacon does not interfere with the vision of the workman working in the vicinity of the ball 3. This may be done by using a colored protective cover. In one exemplary embodiment, the light output is similar to a battery operated road-side flasher.

The audible warning device 22 may be variously configured to include any audible warning signal such as the audible warning signal commonly associated with backing movement of a truck. It may be desirable to maintain the volume of the audible sensor within a range which alerts the workman in the vicinity of the ball to movement of the ball but without interfering with normal communications of the workman. In other words, the workman should still be able to speak over the audible warning noise. To facilitate this objective, the beeping noise emitted by the audible warning device may be limited to occur at a rate of only once per second, or ever other second or every third second. Alternatively, the audible warning noise may be emitted continuously at a particular frequency. The audible warning device 22 may be used in addition to or instead of the beacon light 20.

The local and/or remote sensors/camera devices 12, 13 may be variously configured. For example, the sensors may include any one of a number of local sensors or remote sensors. In one embodiment, the local remote sensors may include a wind detector or boom length/angle detector. In another embodiment, one or more local acceleration sensors are included which detect acceleration of the ball 3 in any one of three dimensions. For example, a vertically and horizontally mounted acceleration sensor may be utilized. The acceleration detector may be any detector known in the art such as a piezoelectric sensor and/or a mercury based sensor. Of these, the piezoelectric based sensor may be more desirable due to the high impact environment often experienced by the ball 3. Further, one or more laser range finder may be incorporated into the remote sensors/camera devices 12, 13. For example, a first laser range finder may be trained on and/or located within the ball to determine the distance of the ball from the boom. A second laser range finder may be located on the boom and/or carriage and used to determine the distance from the boom to the ground or target location where the ball is suppose to be positioned above. The first laser range finder may be utilized by the central control device to determine the rate of acceleration of the ball toward the target such that the ball may be accelerated relatively quickly while it is a great distance from the target and then slow as it approaches the target. In this manner, the overall efficiency of the crane operation may be improved without a decrease in safety.

There is any number of degrees of freedom for the ball of a crane to move. The ball may move at a constant velocity with no acceleration or with a variable or constant acceleration. For example, the ball may move along the boom on a carriage, or the ball may move as a telescoping boom extends or retracts. The ball may also move as the boom swings right or left or moves up or down. In other works, a ball on a typical crane is capable of total three dimensional movement with either a constant velocity and no acceleration or a variable velocity with acceleration. Thus, an acceleration detector alone will not reliably detect when a crane is in motion. Accordingly, a local motion detector may be included in each of the crane warning devices which uses any suitable technique to detect motion. For example, an ultrasonic and/or laser ranging system similar to those employed to focus cameras and/or for target acquisition may be utilized. In one exemplary embodiment, one or more ultrasonic/laser ranging sensors may be mounted to detect the ball's relative distance from the boom 5, target, and/or cab 7. For example, one or more first sensors may be directed towards the boom, and one or more second sensors may be directed toward the cab or out-riggers 8 or target. Further, a plurality of sensors may be located on multiple sides of the ball in the event that the ball twists. In exemplary embodiments, it may be desirable to have two, three, or more motion sensors disposed at spaced locations such that the position of the ball 3 and movement of the ball 3 may be determined at any time via well known triangulation methods. Any number of motion sensors and/or acceleration sensors may be in the crane warning devices (e.g., mounted entirely within the ball) and/or distributed at various locations about the crane 2 and configured to be in electrical and/or electromagnetic communication with the crane warning devices and/or central control device.

Where remote sensors are utilized, the remote sensors may be coupled to the crane's movement mechanisms 6 and/or the crane's electronic control system 47. For example, each time that the crane's hydraulic system 51 is actuated a signal may be sent from any one of a number of remote sensors 42A–42E to the crane warning devices 4 (either directly or via the central control device 11) activating a warning. Each of the crane warning devices need not be actuated by the same signals/sensors. For example, the crane warning devices 4A, 4C proximate to the ball may be activated whenever cable movement is detected to raise, lower, or swing the cable/boom, whereas the crane warning devices 4*b* proximate to the counter weight 10 may only be activated when the operator initiated a swinging action of the cab such that the counter weight swung left or right. In other words, where multiple crane warning devices are affixed to the crane, each warning device may be under separate control and responsive to some separate sensors and/or some common sensors. Further, the crane warning devices may receive control locally, from the central control device 11, and/or from one or more remote sensors including the camera 13. Similarly, the sensors 12, 13 may send signals to the central control device 11 such that the central control device may control the accent and/or decent of the ball and/or the crane warning devices responsive to the sensors 12, 13.

The crane warning devices 4 may be synchronized such that the audible and/or visual warnings emitted from the devices occur in unison. This eliminates much of the noise distortion of many warning devices occurring at the same time but skewed from each other or operating at a different frequency. Further, the audible warning emitted from the warning device may change depending on the motion of the crane. For example, where the ball is moving up, a first audio frequency would be emitted; where the ball is moving down, a second audio frequency would be emitted; where the crane is turning left or right, a third audio frequency is emitted, etc. In this manner, regardless of the indication given by the crane operator, the workers would know what motion to expect out of the crane based solely on the noise emitted by the warning device. Additionally, it may be desirable to delay movement of the crane for a relatively short period of time (e.g., one, two, or three seconds) while the audible tone sounds. This allows the workers have, for example, a fraction of a second notice, before movement of the ball actually takes place.

The local-remote sensors may also include one or more cameras 13. One or more cameras 13 may be mounted directly in the crane warning device 4 using, for example, one or more digitally corrected/concatenated wide angle lens, and/or a camera mounted on the boom/carriage to obtain a birds eye view of the workers and ball. For the wide angle lenses, digital correction techniques and techniques to concatenate the various image views (e.g., to form a 360 degree view) are well know in the art. Where the cameras are mounted on the carriage and/or boom, a manual, fixed, and/or automatic zoom feature may be utilized to improve the visual indication provided to the operator. The visual indication provides the operator with additional information as to the position of the load, ball and workers. Where the camera is mounted on the boom, the camera 13 may include a fixed and/or adjustable zoom control which enables the operator to view the work up-close. Where the zoom of the camera in under operator control, the control may be via one or more remote switches located in the cab such as on control interface 48. The display from the camera 13 may be shown on display 43. The display 43 may be further located close to the line of view of the operator out the window in the cab 7 such that the operator may watch the display while still being able to watch the ball and associated payload out the window. Where more than one remote camera 13 is located about the crane, the display 43 may be subdivided into different windows each showing a different camera angle and/or different displays.

The recharging interface 36 operates to recharge the batteries in the cable warning devices 4 periodically. In some embodiments, the cable warning devices incorporate lithium ion batteries which have a high charge density. One or more retractable recharge cables may be coupled from the main body of the crane to the cable warning devices 4 on a periodic basis to recharge the batteries. Alternatively, the batteries may be manually replaceable with or without an option to plug the replaced batteries into a recharging station on the crane body. In the event of a low battery condition, the crane operator will be warned that the battery 23 in one or more of the crane warning devices 4 is low and needs to be recharged and/or replaced. The indication may occur on the display 43.

The audio processor 23 in the crane warning devices allows the operator to communicate with the workers. Where a microphone and speaker system is included in the warning devices, the operator can communicate with the workers manipulating the ball 3. Conventionally, a worker manipulating the ball must signal the operator visually with one hand. Modem cranes have the operator enclosed in a environmentally controlled enclosure making voice communication impractical. Accordingly, by including a sophisticated audio processor (e.g., and advanced two-way baby monitor/speaker phone) within the warning devices (such as the one in the ball or on the counter weight), one located on one or more workers (e.g., a two way radio) and one within the cabin 7, the crane operator may have two way communication with the workers. In this manner, worker safety is vastly increased because the worker may use both hands to manipulate the load while verbally signaling the operator. Where the communication device is located in the ball, the communication device also improves over radio communications since neither the operator or the workman have to carry or wear a radio. Further, the speaker and microphone are always present in the ball further improving safety where, for example, a worker forgets his radio and/or the radio is not working due to low battery power. Further, by building the audible device into the ball of the crane, the workers do not have to utilize one hand to operate hand-held radios or other communication devices. Where both a camera and an audio processor are utilized, the combination of theses devices taken together, vastly increases safety and efficiency of the crane operating environment over either device used individually.

The audio processor may be further configured to electronically filter the noise from the crane's audible warning device so as not to interfere with normal communication with the crane operator. This electronic filtering is done to filter out the beeping or tones emitted from the warning device without filtering out the normal voice of the operator and/or worker. Where the beeping noise occurs at a predetermined frequency, an electronic filter in the audio processor may be utilized to eliminate or severely attenuate the warning noise such that the operator can easily communicate with the workers. The verbal communication to each of the warning devices further enhances safety in that the operator has immediate communications with all sides of the crane. For example, where another worker notices a safety concern, he can communicate with the operator using any one of the cable warning devices 4.

Communications between the various motion sensors, warning devices 4, and/or central control device 11 may be accomplished using any suitable mechanism such as transmitter/receiver devices 24, 49. For example, the devices may communicate using electromagnetic waves such as radio waves. In some embodiments, a radio frequency in the range of about 900 MHz may be to communicate between the warning device coupled to the ball and the warning device coupled to other portions of the crane. Suitable error correction codes, loss of signal detection, and channel hopping may be incorporated into the transmitter/receiver devices 24, 49 to increase safety and reliability. In the event of loss of communications, the warning devices 4 and/or central control device may be programmed to sound an alarm. In still further aspects of the crane warning system 1, fail-safe mechanisms may be built into the crane warning device such that the warning device is activated whenever a sensor fails or loses contact (e.g., radio contact) with the warning device. Further, a crane warning device status monitor may be built into the cabin of the crane so that the operator may be warned of any operational problems with any of the sensors in a timely fashion. Further, the operator may be able to determine and/or select a particular microphone/speaker to which to communicate.

In addition to the above, the camera feed may be sent from the camera(s) 13 and/or central control device 11 to two or more locations. For example, the camera feed may be sent to a monitor mounted in the site supervisor's and/or foreman's trailer. Further, the remote feed may be transmitted via a telephone link and/or other link to a remote office such as the construction companies headquarters such that the main company may track the progress of each of its construction projects in real time. In this manner, the site supervisor and/or foreman may be able to monitor the activities of the site to determine work progress and/or worker activity and be alerted to potential safety problems immediately. Further, the central office may be able to centralize ordering and scheduling activities from the main office without having to distribute staff to each of the individual work sites.

Figure 9:
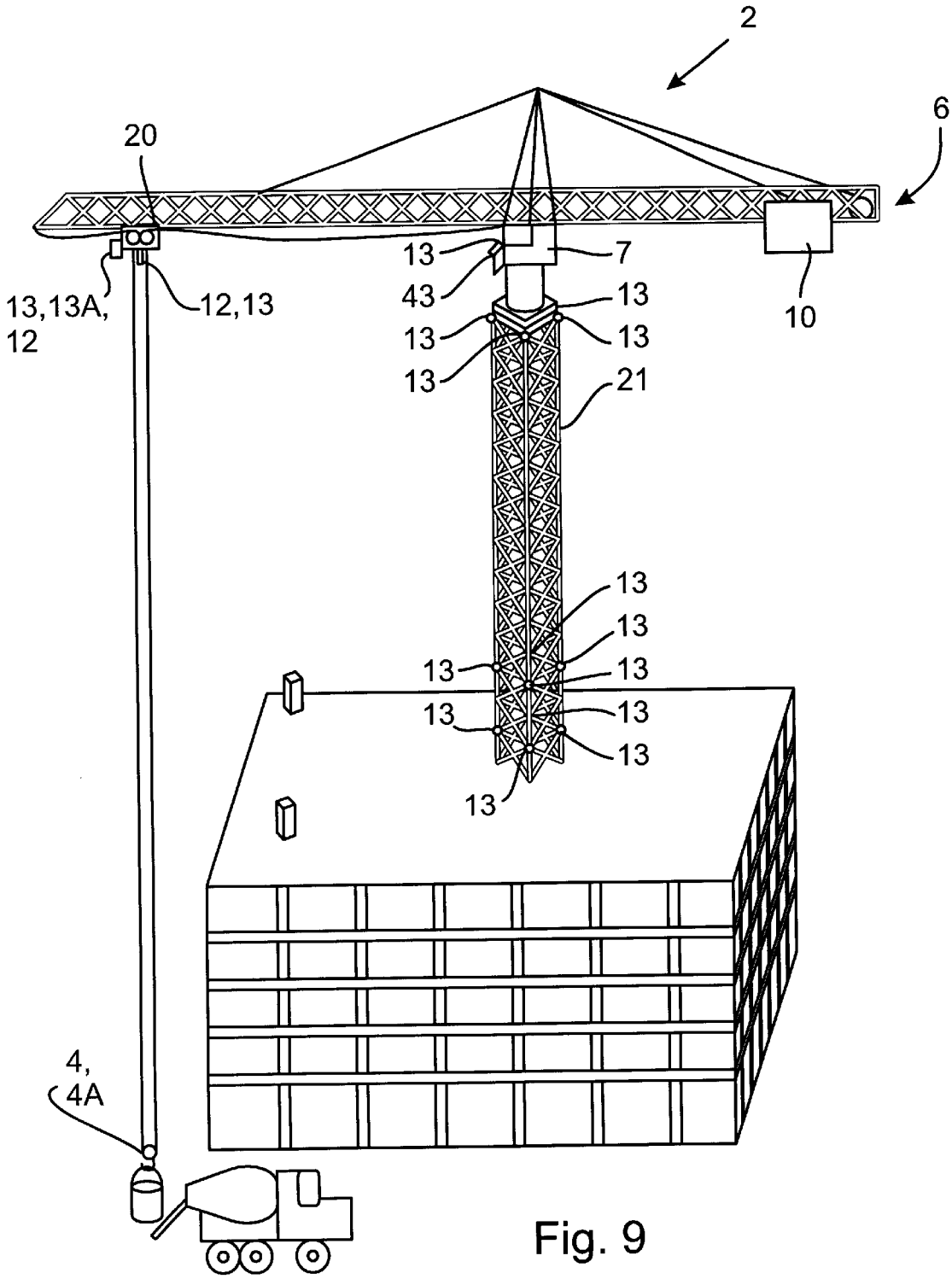
FIG. 9 is a perspective view of second embodiment of a crane incorporating aspects of the invention.

A second exemplary embodiment of the invention is shown in FIG. 9. As shown in FIG. 9, the crane 2 may be a crane commonly utilized to construct tall buildings. The camera may be mounted on the carriage 20. Further, the cameras and/or sensors 12, 13, 13A may also be mounted on the carriage. Additional cameras may be mounted on other locations of the crane such as the cab 7. The camera mounted on the cab 7 may be configured to track the ball knowing the location of the carriage 20 (using, for example a laser range finder mounted to the carriage and directed toward the cabin, and/or on the cabin and directed towards the carriage) and the location of the ball using a second range finder located on the ball and/or on the carriage 20). In this manner, the camera may be automatically moved to track the current location of the ball and zoom in on the work area.

Further, the mounting of the camera on the carriage allows the operator to see around blind ends of the building as the building is constructed such that the crane operator may see areas which would otherwise be obstructed. In this manner, the overall speed, efficiency, and safety of the crane operation is improved. Cameras are known in automated manufacturing environments where cranes are also utilized to transport various components along the manufacturing line. However, the use of remotely mounted cameras on the boom, cradle, and/or ball of a cantilever type crane has not heretofore been done, particularly in the construction industry. In the construction industry, there is a high incidence of accidents due to common obstructions which block the view of the crane operator and conditions (e.g., surrounding buildings and location of shafts within the building) which prevent the operator in the cab from being able to adequately see and access the area around the ball. Further, for very tall buildings, the cranes are often many stories above the work area. Thus, there is a substantial need to address these safety concerns by providing cameras having appropriate angles and mounting locations (particularly as positioned on the boom, cradle, or ball or a cantilevered construction crane) to ensure safe operation. The cameras are particularly applicable to construction cranes with cantilevered horizontal booms which extend for 100 feet or more since it is difficult for the operator to see over and around obstructions which typically occur in this environment. Additionally, cameras in accordance with aspects of the invention are particularly applicable to cantilevered booms extending 100 feet or more which are positioned on the ground and utilized to place construction materials or other items used in construction on locations above where a building is being constructed.

As an alternative embodiment, a communication bus such as an Ethernet, fire wire, and/or fiber optic communication path may be disposed along the tower, and/or from the boom to the cab in order to facilitate communications from the various sensors/cameras, the cab, and/or any remote sites (e.g., a trailer).

Figure 10:
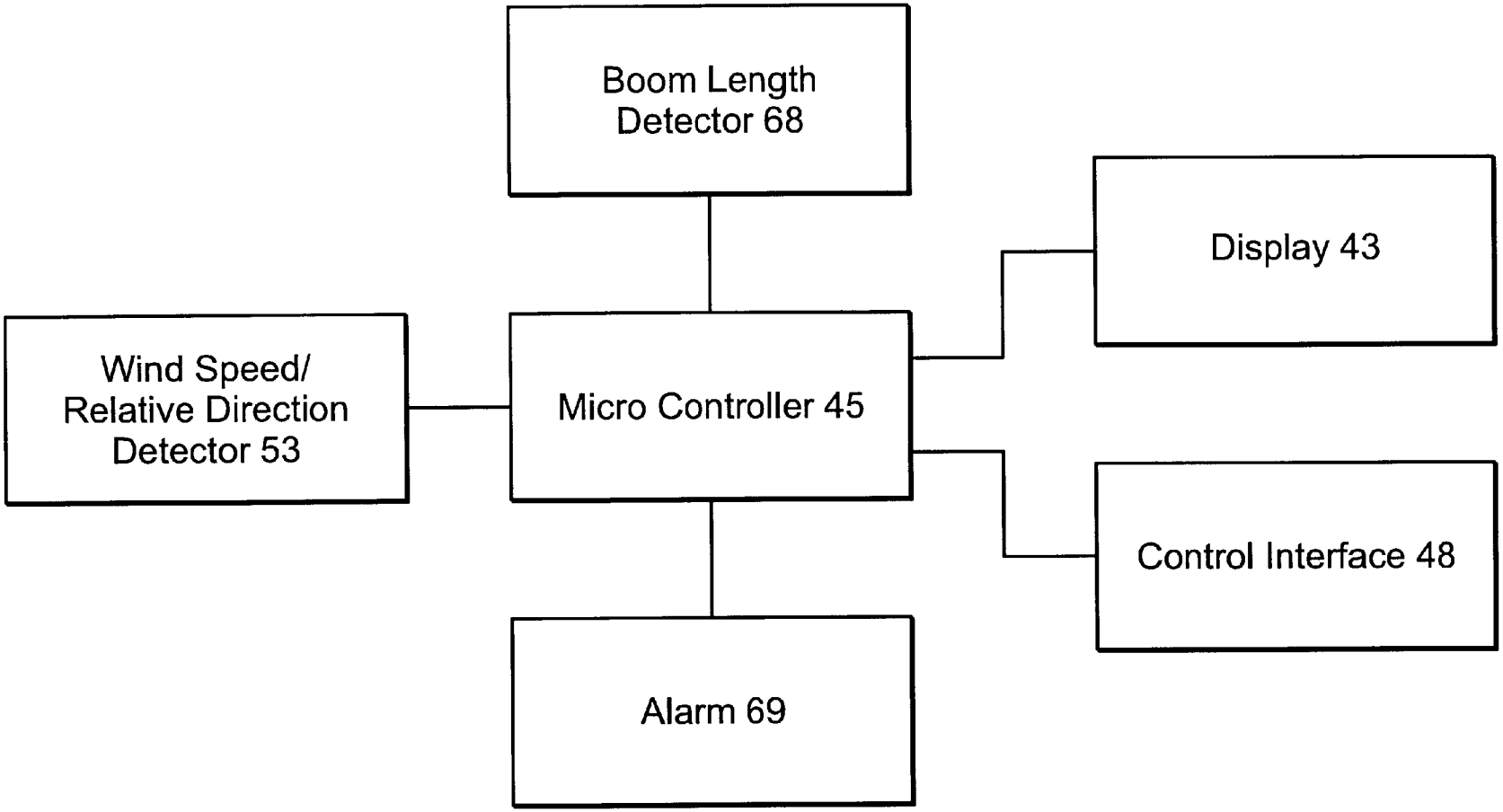
FIG. 10 is a schematic diagram illustrating a crane safety device according to an embodiment of the invention.

FIG. 10 illustrates a crane safety device according to another embodiment of the invention. In this embodiment, the safety device includes a wind detector 53, a boom length detector 68, an alarm 69, the microcontroller 45, the display 43 and the control interface 48. FIG. 10 shows a simplified block diagram of the exemplary system shown in FIGS. 6 and 7. As will be explained in detail below, the wind detector 53 may be utilized to detect information relating to wind proximal to the crane. The wind detector then provides this information to the microcontroller 45, which transmits this information to display 43.

In this embodiment, the display 43 may display the wind information from the wind detector 53 for the crane operator. Thus, the display 43 may display current wind information, collected from the wind detector 53, to the crane operator, so that the crane operator may more safely operate the crane. The display 43 may be any conventional display. For example, the display 43 may be a cathode ray tube display or a liquid crystal display. Alternatively, the display 43 may be a "heads-up" type display, that projects an image onto, for example, the windshield of the crane's cab 7, or the eyes of the crane operator. The use of such a "heads-up" type display allows the crane operator to view relevant safety and control information without having to divert attention from the load being carried by the crane. The display 43 may be used as a configuration display and/or a display to output video information (e.g. camera feeds) to the operator. In exemplary embodiments, one or more display "windows" or overlays may be utilized for this function. Alternatively, one or more separate displays may be utilized, e.g., one for control and one for video feedback.

Embodiments of the invention may also employ a control interface 48 with the display 43. The control interface 48 may be integrated with display 43 (as with a touch-screen display), or may be a separate module. The control interface 48 receives data input by the crane operator, and passes this information back to microcontroller 45. Microcontroller 45 can then operate the crane according to the operator's instructions. Thus, the crane operator may directly operate the crane in response to detected wind information.

Figure 11:
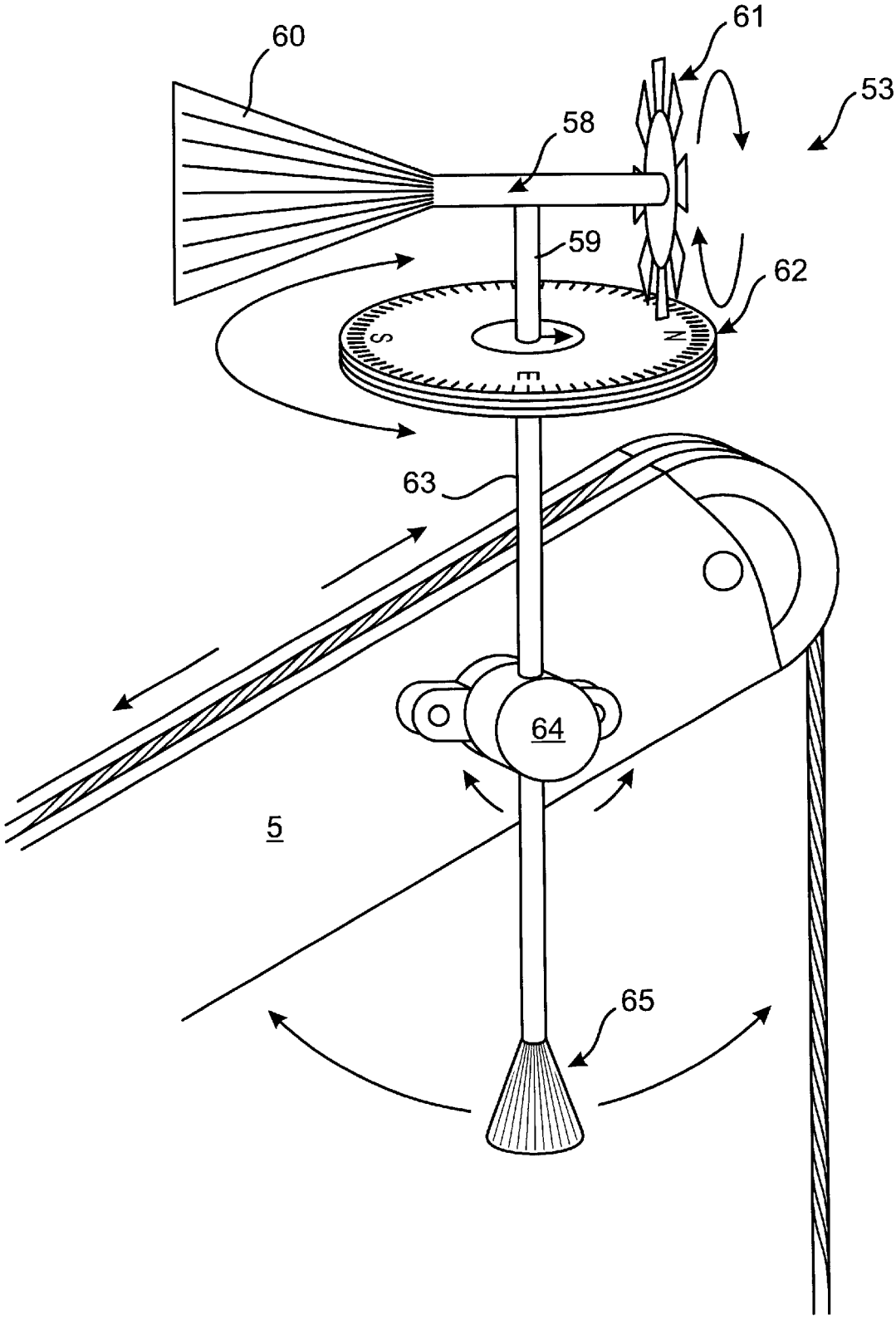
FIGS. 11 and 11B each show a perspective view showing a wind sensor.

A preferred wind detector is shown in FIG. 11. The wind detector 53 may include a rod 58 transversely mounted on a support shaft 59. One end of the rod 58 may be connected to a vane 60, while the opposite end of the rod 58 may be connected to a pinwheel 61. The support shaft 59 may be rotatably mounted on a compass 62 or, alternatively, on an optical rotation detector. Further, any suitable angular displacement device may be utilized to detect the direction of the wind relative to the boom direction. For example, the shaft 59 may include an optical encoder which detects whether the wind is blowing in a direction perpendicular to the boom 5, towards the front of the boom 5, towards the rear of the boom 5, or any direction in-between. The use of an optical encoder provides accurate determination of the wind direction relative to the boom direction irrespective of the location of the crane or external magnetic interference.

In embodiments where a compass is used, when wind blows past the wind detector 53, the vane 60 turns the shaft 59 so that the direction of the vane 60 matches that of the wind. Thus, the rotation of the shaft 59 relative to the compass 62 may identify the wind direction relative to the boom direction. Alternatively, one or more compasses or encoders may also be used to measure the direction of the boom 5 itself. Thus, the microcontroller 45 can use the information from the wind detector 53 to determine the direction of the wind relative to the direction of the boom 5.

The pinwheel 61 measures the speed of the wind in a conventional manner. For example, the rotating shaft supporting the pinwheel (not shown) may be connected to an optical encoder that provides a digital or analog voltage value corresponding to the rotational speed of the shaft.

Where connector 64 pivotably attaches the rod 63 to the boom 5, it may be desirable to include a counterweight 65 at the opposite end of the support rod 63 from the wind detector 53. This arrangement is advantageous in that the vertical attitude of the wind detector 53 remains constant, regardless of the angle and elevation of the boom 5.

Figure 11B:
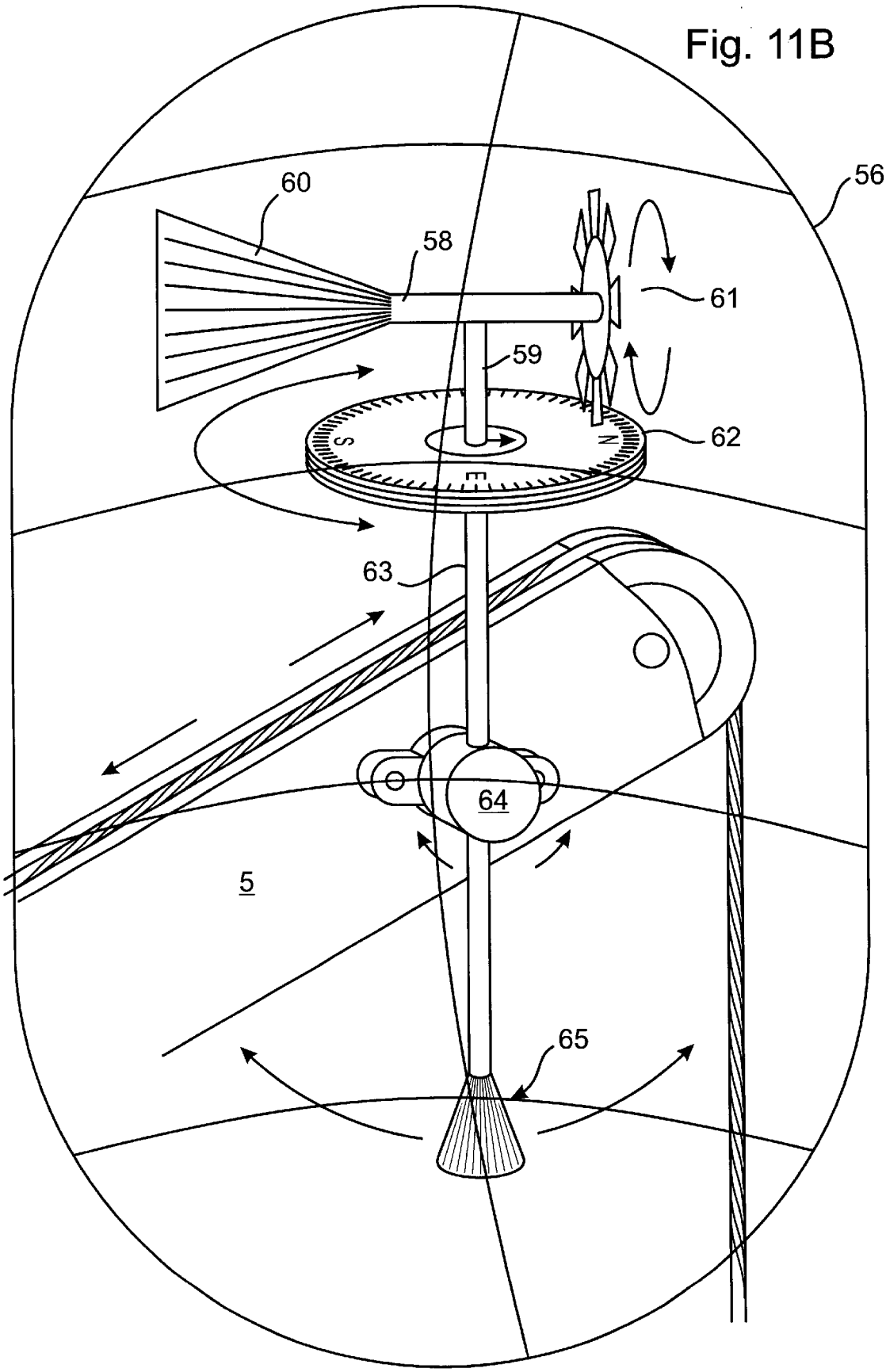

While this preferred wind detector 53 includes a vane for measuring wind direction and a pinwheel for measuring wind speed, other structures can be employed. For example, it is well known to use lasers to measure wind speed and direction. For example, the laser wind detector may be completely protected by an enclosure mounted on the end of the boom. The laser may be pointed along the boom and reflected back to the detector. In this manner, the average wind speed along the boom may be accurately determined using a single sensor. In some embodiments where high reliability is desired, laser detectors are preferred even where they involve additional costs. Also, instead of the compass 62, the wind detector 53 could use a gyroscopic system to determine the direction of the wind or the direction of the wind relative to the direction of the boom 5. A gyroscopic system allows the crane operator to accurately ascertain the direction of the boom relative to the wind, irrespective of the crane's location or external magnetic interference. It is also possible to use a plurality of wind detectors 53. For example, a first wind detector 53 can be mounted at the outer end of boom 5, a second wind detector 53 can be mounted on the cab 7, and a third wind detector along the boom 5. According to one particularly preferred embodiment, a number of wind detectors 53 are positioned at intervals along the length of the boom 5. The use of multiple wind detectors allows the system to more accurately measure the overall wind speed despite the occurrence of brief localized gusts of wind. The wind detector may also comprise a protective cage 56 (see FIG. 11B) disposed about the wind detector 53.

The display 43 can display some or all of the information collected by the wind detector (or detectors) 53. This allows the crane operator to safely operate the crane in view of the prevailing wind characteristics. Further, the display 43 can display additional information calculated by the microcontroller 45 from the wind characteristics. For example, the microcontroller 45 and display 43 together can calculate and show the wind load of the crane based upon the surface area of the boom 5 and the direction of the boom 5 relative to the wind direction.

When the embodiment of the invention includes control interface 48, the invention is an interactive system that allows the crane operator to control the operation of the crane in response to wind information provided by the wind detector. For example, the crane operator can input the current load weight for the crane. The microcontroller 45 and display 43 can then calculate and display the safe operating parameters of the crane based upon the surface area of the boom 5, the direction of the boom 5 relative to the wind direction, and the current load weight. Where high wind conditions prevail, the microcontroller 45 can automatically reduce the maximum rated load for a particular crane configuration and have display 43 inform the operator of the maximum rated load.

Figure 12:
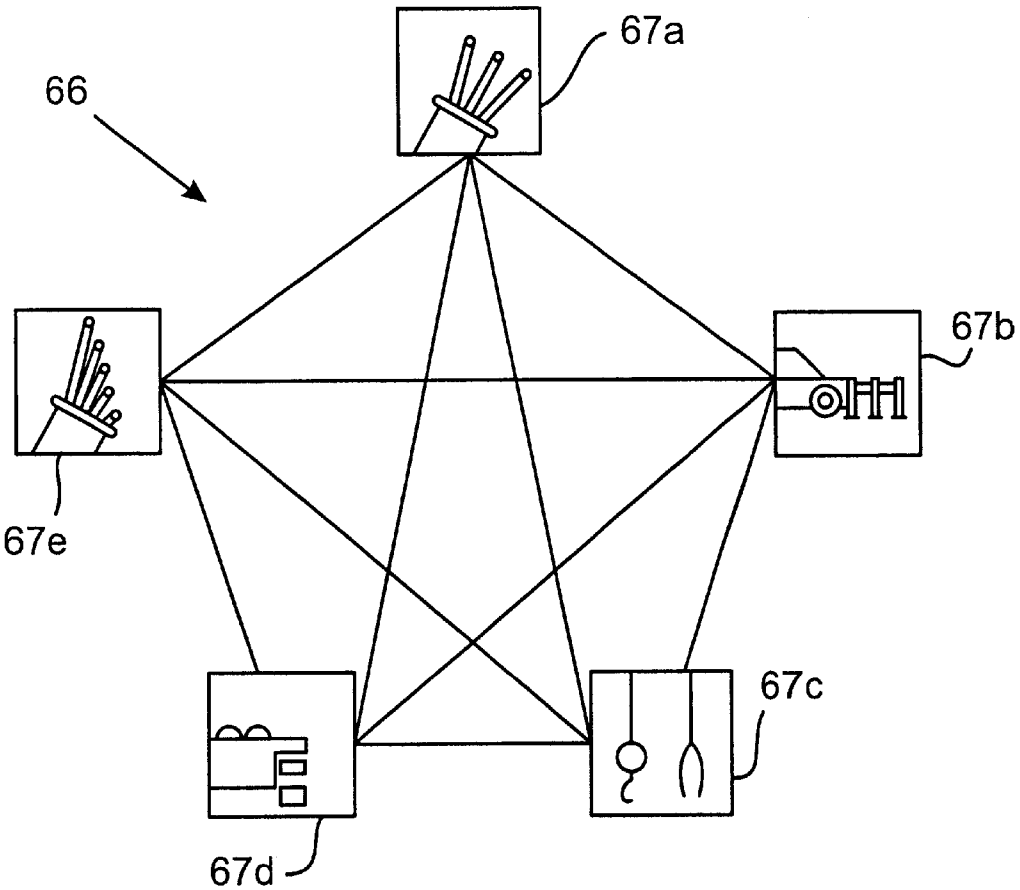
FIG. 12 is a schematic diagram illustrating a decision network for configuring a crane according to a fifth embodiment of the invention.

Preferably, the microcontroller 45, display 43 and control interface 48 allow the crane operator to control the operation of the crane by employing a decision network 66, as shown in FIG. 12. The decision network 66 includes a number of control nodes 67. Each control node 67 corresponds to a control operation for a particular configuration of the crane. For example, node 67*a* may correspond to a control subroutine for controlling the angle of the boom 5. Node 67*b* may then correspond to a control subroutine for controlling the position of the crane support, while node 67*c* may correspond to a control subroutine for controlling the type of hook used by the crane. Node 67*d* can then correspond to a control subroutine for controlling the crane's counterweight, while node 67*e* may correspond to a control subroutine for controlling the type of boom extension employed by the crane. As will be seen from FIG. 12, the nodes 67 need not be accessed sequentially. Instead, any control node 67 may be accessed from any other control node 67. This arrangement allows the crane operator to quickly reconfigure specific features of the crane without having to go through a lengthy control process.

Figure 13:
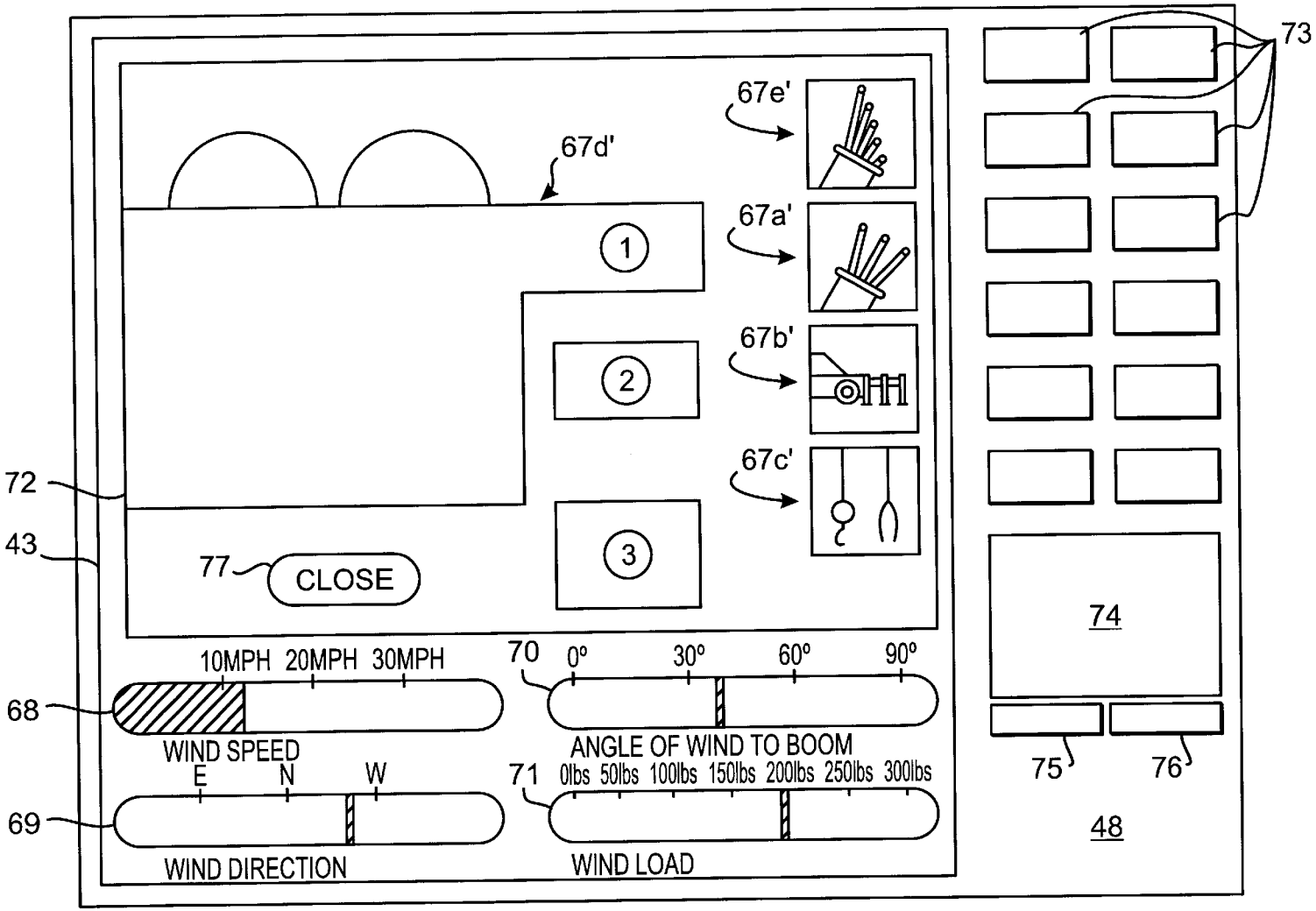
FIG. 13 is a pictorial view of one display implementing aspects of the invention.

FIG. 13 illustrates one embodiment of the display system 55 in more detail, and illustrates one implementation of a decision network 66 according to an aspect of the invention. As seen in the figure, embodiments of the invention may include the display 43 and control interface 48. The display 43 may display, for example, wind information images 68–71, that show the wind speed, wind direction, angle of wind to boom and wind load, respectively. The display 43 may also display a decision network control image 72, for controlling the operation of the decision network to thereby control the operation of the crane. The control interface 48 may include a plurality of control keys 73. Control keys 73 may be alphabetical keys, numeric keys, function specific keys (e.g., "On," "Off," "Start"), or any combination thereof. The control interface 48 may also include a dynamic pointing device, such as touchpad 74 with associated trigger buttons 75 and 76. The use of touchpad 74 allows the crane operator to more efficiently control the selection of features on the display 43, but is resistant to dirt and damage. It should be noted that other dynamic pointing devices, such as a trackball, pointing stick, stylus, etc., may be employed, where, for example, the control interface 48 is vertically mounted so that a touchpad cannot be efficiently used.

As shown in FIG. 13, the display 43 may display a decision network control image 72. In one embodiment of the invention, the decision network control image 72 includes an image 67' corresponding to each node 67 of the control network. For example, the decision network control image 72 shown in FIG. 13 includes node images 67*a*', 67*b*', 67*c*', 67*d*', and 67*e*' corresponding to decision network nodes 67*a*, 67*b*, 67*c*, 67*d*, and 67*e*, respectively. With this arrangement, a crane operator can employ the touchpad 74 or control keys 73 to select a node image corresponding to a desired node operation. In the figure, node image 67*d*' (corresponding to the node 67*d* for counterweight control) is enlarged, indicating its selection by the crane operator. The operator can then select a specific weight shown in the node image 67*d*', using either the touchpad 74 or the control keys 73. Selection of a specific weight in the node image 67*d*' instructs the control node 67*d* to configure the crane for that weight. After the crane operator selects a specific weight, he can deselect the control node 67*d* by selecting the "CLOSE" button 77 on the node image 67*d*'. This interface is advantageous over that disclosed in, for example, U.S. Pat. No. 5,731,974, in that it allows the operator to scan all configuration parameters simultaneously providing multiple opportunities to correct any errors and facilitating ease of use.

From FIG. 13, it will be appreciated that each of the node images 67' may simultaneously be included in the decision network control image 72. Thus, two or more control nodes may be selected for operation simultaneously. This allows the operator to configure various parameters of the crane at a single time, so that the operator can readily ascertain the status of all of the crane's parameters that are interrelated. Further, as shown in FIG. 13, all of the node images 67' may simultaneously be displayed in the decision network control image 72. This allows the crane operator to move from any node image 67' to any other node image 67', thereby permitting the crane operator to control specific features of the crane without having to go through a lengthy control process.

Figure 14:
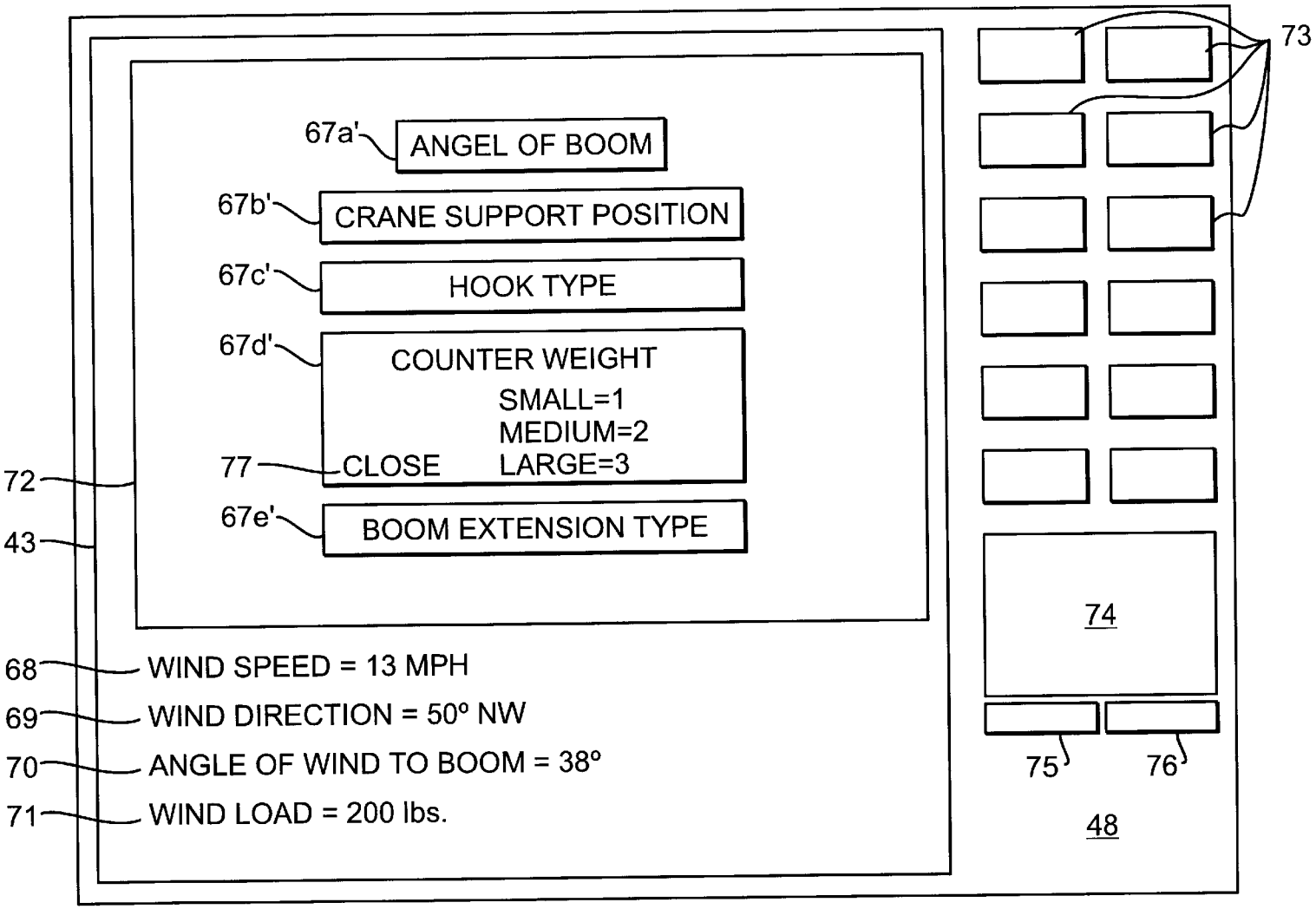
FIG. 14 is a pictorial view of another display implementing aspects of the invention.
Figure 15:
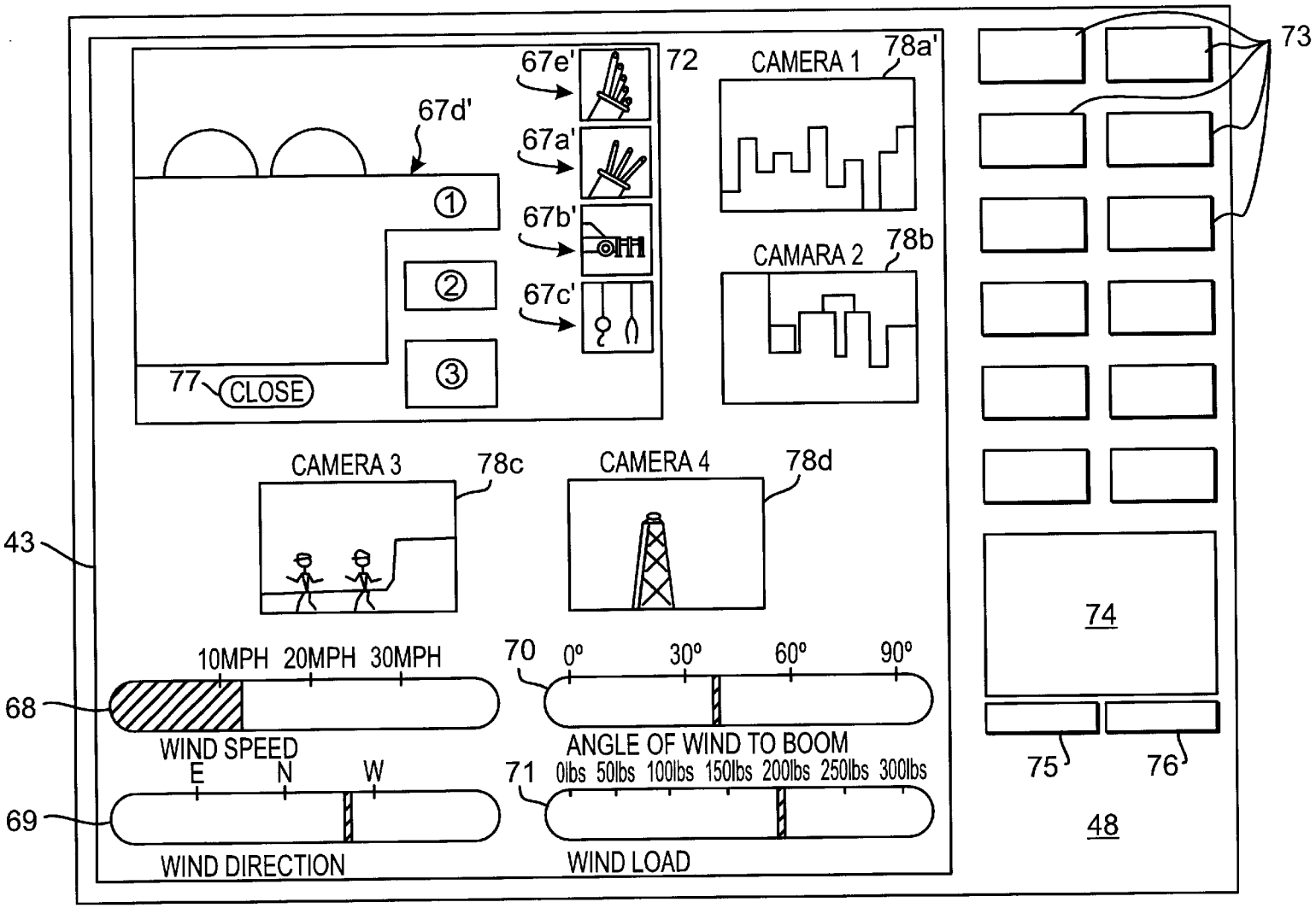
FIG. 15 is a pictorial view of still another display implementing aspects of the invention.
Figure 16:
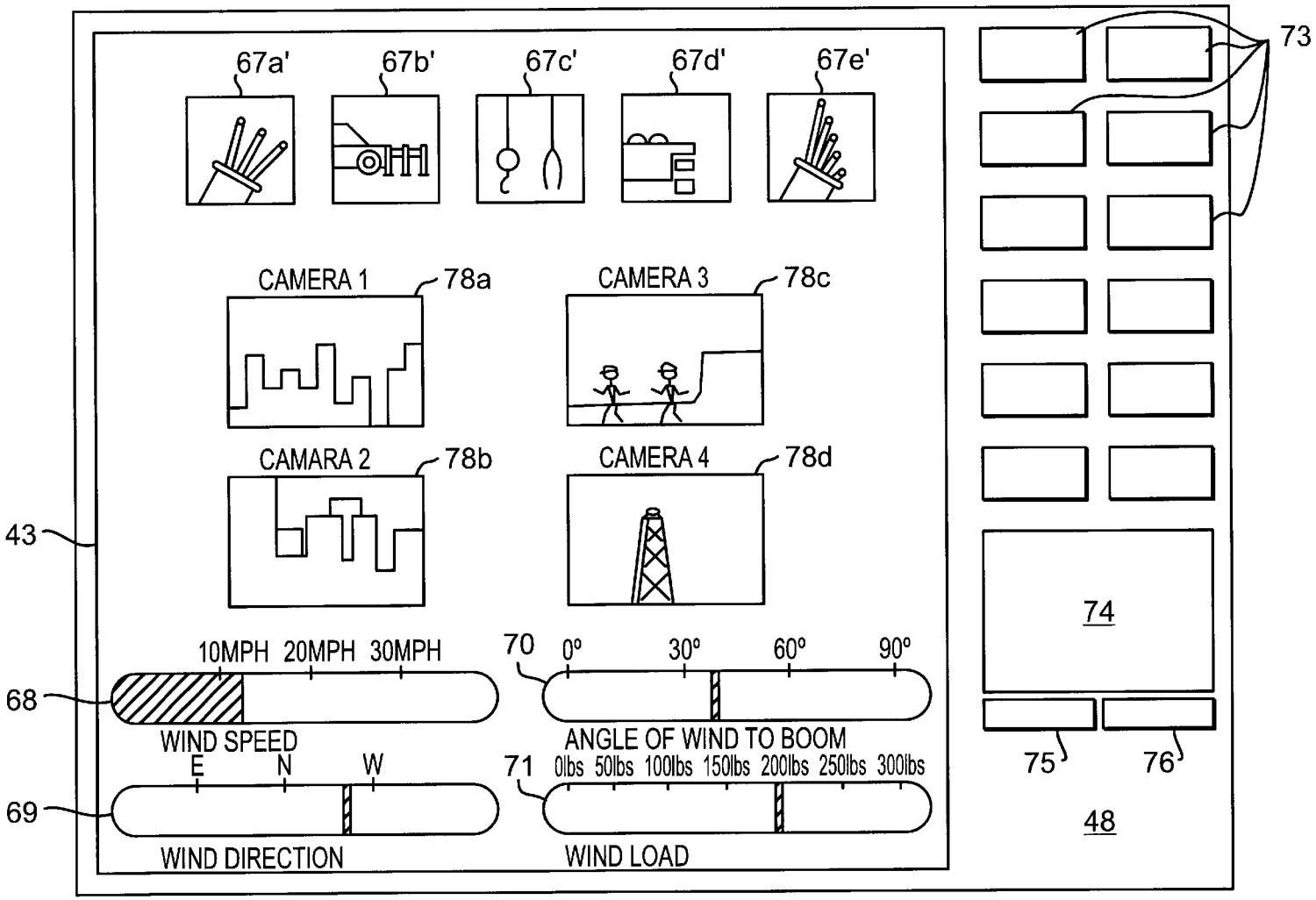
FIG. 16 is a pictorial view of yet another display implementing aspects of the invention.

While the display 43 shown in FIG. 13 includes pictographic images, alternate embodiments of the invention can display text images, as shown in FIG. 14, or a combination thereof. Also, as noted above, the display can show images taken by remote camera units 13. As shown in FIGS. 15 and 16, the display can show both node images 67 and camera pictures 78. FIG. 15 illustrates one embodiment of the invention where camera pictures 78*a*–78*d* are displayed simultaneous with but separate from the decision network control image 72. FIG. 16 illustrates another embodiment of the invention where the control node images 67 are included in the same window as the camera pictures 78*a*–78*d*. Of course, the windows showing both the node images 67 and the camera pictures 78 can be overlaid, tiled, and otherwise arranged as known in the art.

In addition to active control by the crane operator, the microcontroller 45 may also automatically control the operation of the crane. For example, the microcontroller 45 may limit the rotational movement of the boom 5 based upon the wind load, to prevent the boom 5 from turning too transverse to the wind direction. The microcontroller 45 may also prevent boom 5 from being lengthened if the wind speed exceeds a preset value.

Where the crane includes a boom length detector 68, the boom length detector 68 may detect the current length of the boom 5, and provide this information to the microcontroller 45. Thus, the microcontroller 45 may obtain the present boom length from boom length detector 68, and the wind speed and direction from one or more wind detectors 53. From this information, the microcontroller 45 can more accurately calculate the current wind load on the boom 5, and display some or all of this information (e.g., wind speed, wind direction, wind direction relative to boom direction, and boom length) to the crane operator through display 43. As with previously described embodiments, the boom operator can then control the operation of the crane through control interface 48. Also, the microcontroller 45 may automatically control or limit operation of the crane based upon the wind information and boom length.

The boom length detector 68 can be separate from the wind detector 53, or may be an integral component of the wind detector 53. For example, the boom length detector 68 can include an optical encoder with a shaft that rotates in a first direction when the boom 5 is extended, and rotates in the opposite direction when the boom 5 is retracted. The use of an optical encoder will facilitate precise measurement of the boom length. Alternately, if a number of wind detectors 53 are located along the length of the boom 5, distance measuring lasers can be included in the wind detectors 53 to measure the distance between them (and thus the current length of the boom 5). The use of distance measuring lasers that are included with the wind detectors 53 allow a crane to be easily and simultaneously retrofitted with both. Other variations and arrangements for the boom length detector 68 will be apparent to those of ordinary skill in the art.

Where the crane includes an alarm 69, the alarm 69 may activate when the wind speed measured by the wind detector 53 exceeds a preset value. The alarm may be activated by a number of different parameters (e.g., wind load, load weight, etc.), however, in addition to or instead of a threshold wind speed value. The alarm may be a visible alarm, such as a flashing light, or an audible alarm, such as a siren, or both.

While exemplary crane warning devices embodying one or more aspects of the present invention are shown, it will be understood, of course, that the invention is not limited to these embodiments. Modifications may be made by those skilled in the art, particularly in light of the foregoing teachings. It is, therefore, intended that the appended claims cover any such modifications which incorporate the features of this invention or encompass the true spirit and scope of the invention. For example, each of the elements and/or steps of the aforementioned embodiments may be utilized alone or in combination with other elements and/or steps from other embodiments. For example, it is specifically contemplated by the inventor that any one of the following may be claimed either alone or in combination with one or more of the other elements below:

1. Camera mounted on carriage;
2. Camera mounted on ball;
3. One or more cameras mounted on cab;
4. One or more cameras mounted on a cantilevered boom of a construction crane;
5. One or more cameras mounted on tower;
6. One or more cameras mounted on counterweight;
7. One or more cameras mounted about the cab (e.g., in a 360 degree view);
8. One or more cameras mounted about the tower (e.g., in a 360 degree view);
9. One or more cameras mounted about the tower (e.g., in a 360 degree view) in multiple vertical locations showing a 360 degree horizontal view (about 90 degrees per camera);
10. Zoom camera mounted on any of the above;
11. Manually controlled zoom camera mounted on any of the above with controls located in the cab;
12. Automatically controlled zoom camera mounted on any of the above;
13. Wide angle camera mounted on any of above;
14. Camera mounted on any of the above with display in the cab;
15. Camera mounted on at least two of the above locations with multiple displays in the cab;
16. Camera permanently mounted on at least two of the above with multiple display windows on a single display in the cab;
17. Camera mounted on any of the above with the feed going to a display located in a remote location such as a trailer;
18. One or more cameras mounted on any of the above with a feed going to a display located at a remote location such as the construction company's headquarters;
19. Sensor (e.g., range finder) mounted on carriage, cab, tower, ball, boom and/or cable;
20. Sensor readings displayed in cab;
21. Sensor readings used to control assent and/or descent of ball;
22. Sensor readings used to increase acceleration and/or deceleration while ball is not close to target or boom;
23. Sensor used to determine zoom of camera and/or manual zoom of camera controlled by operator;
24. Sensor used to determine where the camera is controlled to point;
25. Sensor used to determine a relative distance between the ball and target (e.g. floor or ground location);
26. Sensor used to determine when the warning device is to be activated responsive to movement of the ball;
27. Acceleration sensor used to determine activation of warning device;
28. Motion sensor used to determine activation of warning device;
29. Hydraulic sensor used to determine activation of warning device;
30. Sensor coupled to warning device via electromagnetic waves;
31. Sensor coupled to control system of crane;
32. Crane warning device coupled to central control device via electromagnetic waves;
33. Warning device emitting a modified signal based on sensor output;
34. Warning device emitting a different signal on assent than on decent;
35. A crane ball including a crane warning device;
36. A crane ball including a flashing and/or strobe light;
37. A crane ball including an audible beeper;
38. A crane warning device visible from all sides;
39. Display of camera feed located about cab;
40. Display of camera feed located in a line of sight where the operator can see both the display and the ball out the window of the cab;
41. A plurality of camera displays located about the cab;
42. A plurality of camera images being displayed on a single display in windows;
43. Display of the camera feed in a remote location such as in the site foreman's or site supervisor's cabin;
44. Display of the camera feed in both a remote location and in the cab;
45. Speech processor located in the ball;
46. Speech processor located about cable above ball;
47. Microphone located in the ball;
48. Microphone located about cable above ball;
49. Speaker phone located in ball and communicating with cab;
50. Speaker phone being located on a workmen working in vicinity of ball and communicating with cab;
51. Speaker phone located in vicinity of ball having a digital filter to filter out noise of warning device;
52. Microphone and speaker being mounted in cab and in ball allowing two way communication between cab and workers in, the vicinity of the ball;
53. A crane having a plurality of distributed crane warning devices;
54. A plurality of distributed crane warning devices emitting a beeping noise while the crane is in motion;
55. A plurality of distributed crane warning devices, each being coupled to a different sensor to emit a warning signal responsive to different events (e.g., movement of ball, movement of counter weight);
56. A plurality of crane warning devices emitting a synchronized warning signal;
57. A crane warning device including a microphone and speaker;

58. A crane warning device including a camera;
59. A plurality of crane warning devices communicating with a central control device;
60. A crane comprising a crane, boom, and ball, with a camera mounted on the boom directed at the ball;
61. A crane comprising a crane, boom, carriage, and ball, with a camera mounted on the carriage facing the ball;
62. A crane having an warning device mounted on a counter weight;
63. Varying a signal emitted by an electronic warning indicator responsive to the type of motion being initiated by a crane ball;
64. Emitting a signal from an electronic warning indicator just prior to actually initiating the movement;
65. A method comprising having two crane warning devices communicating with each other;
66. A method comprising employing a plurality of remotely mounted crane ball movement warning sensors communicating with a central control device;
67. Locating an antenna within an open enclosure of a crane ball;
68. Locating a light within an open enclosure of a crane ball;
69. A light with a colored protective cover within an open enclosure of a crane ball;
70. Locating a flashing light within a open enclosure of a crane ball;
71. Locating multiple speakers (e.g., each facing a different direction) within a crane ball;
72. Locating a crane warning device such that it surrounds a cable in a location proximate to a ball of a crane;
73. Disposing batteries within a ball of a crane;
74. Disposing a removable battery pack within a ball of a crane;
75. Disposing batteries with a recharging interface in a ball of a crane;
76. Locating a battery recharging station on a crane;
77. Locating a battery in a crane warning device;
78. Disposing a communication link along the tower (e.g., an Ethernet connection);
79. Disposing a communication link along the boom (e.g., an Ethernet connection);
80. Using a communication link to communicate between the cab and a remote sensor and/or camera;
81. Using a communication link to communicate between the cab (e.g., central control device) and a remote site such as a trailer and/or a central office;
82. Disposing failure mode detectors within the warning devices to give the crane operator an indication when one or more of the crane warning devices is inoperable;
83. Having a test loop where the speaker emits a predetermined tone which is thereafter detected by the microphone in the crane warning device to have a periodic self test;
84. Output of sensor shown over display in cab as an overlay;
85. A ball with an open enclosure;
86. A ball with an open enclosure having a camera disposed therein;
87. A signal processing device including an electronic filter for reducing the level of beeps heard by an operator in a cab relative to voice input to a microphone in a ball;
88. Display in the cab (e.g., an overlay on display) showing distance to target or floor, distance of ball from floor or boom, distance of carriage from cab along boom;
89. A central control device including a memory, a controller, and a signal processor located in an arrangement supported by the tower and controlling any one of the above;
90. A central control device including an antenna for remotely communicating with at least one crane warning device;
91. Mounting a range finder (e.g., a laser range finder) on a ball of a crane;
92. Mounting a range finder (e.g., a laser range finder) on a cab of a crane;
93. Mounting a range finder (e.g., a laser range finder) on a carriage of a crane;
94. Mounting a range finder (e.g., a laser range finder) on a carriage of a crane pointing at the ball;
95. Mounting a range finder (e.g., a laser range finder) on a carriage of a crane pointing at a target (floor) which lies below the ball and any associated payload;
96. Mounting a range finder (e.g., a laser range finder) on a boom of a crane;
97. Mounting a sensor on hydraulics of a crane to detect motion;
98. Coupling a sensor to a movement mechanism of a crane to detect motion;
99. Using a laser range finder on a crane;
100. Using an acceleration detector on a crane;
101. One or more wind speed and/or direction detectors mounted on a crane;
102. Using an optical encoder to determine wind direction;
103. Using a compass to determine wind direction;
104. Mounting a wind speed and/or direction detector on a crane so that it maintains a constant vertical attitude;
105. Using a laser to determine wind speed;
106. Using a pinwheel to determine wind speed;
107. Using a gyroscopic system to determine wind direction;
108. A protective cage to cover a wind speed and/or direction detector;
109. A display for displaying information collected by a wind speed and/or direction detector;
110. A display for showing wind load of a crane based upon the surface area of the crane's boom and the direction of the boom relative to the wind;
111. A control system that calculates and/or displays a maximum rated load for a particular crane configuration;
112. Using a decision network to control operations of a crane;
113. A decision network for controlling the operations of a crane where any control node of the network can be accessed from any other control node of the network;
114. Using a touchpad, trackball, pointing stick, stylus or other dynamic pointing device to input information into a decision network for controlling the operation of a crane;
115. A decision network for controlling the operations of a crane that employs pictorgraphic and/or text images;

116. A boom length detector for detecting the length of a boom;

117. Determining the wind load of a crane based upon one or more of wind speed, wind direction, wind direction relative to the crane's boom's direction, and the crane's boom's length;

118. An alarm that activates when a crane's wind load or load weight exceeds a predetermined parameter;

119. Using a display to display one or more of a wind speed, wind direction, wind direction relative to a crane's boom's direction, a crane's boom's length, and a wind load;

120. Using a display to display one or more of a wind speed, wind direction, wind direction relative to a crane's boom's direction, a crane's boom's length, a wind load, safe operating parameters of a crane, and a decision network image for controlling the operation of a crane;

121. Using a "heads-up" display to display one or more of a wind speed, wind direction, wind direction relative to a crane's boom's direction, a crane's boom's length, a wind load, and a decision network image for controlling the operation of a crane.

Additionally, one or more of the above elements may be combined with another element, method, or technique shown in the drawings or described in the specification. For example, one or more of the above elements may be utilized on a cantilevered construction crane having a boom length of at least 80 feet and even more desirable for those cantilevered construction cranes having a total boom length in excess of 100 feet.

We claim:

1. A crane device, comprising:

a system for determining and providing information concerning wind proximal to the crane device, the system comprises a first detector apparatus for determining a first component of the wind proximal the crane device, and a second detector apparatus for determining a second component of the wind and the position of a portion of said crane device relative to said second component of the wind; and a display system including a display for displaying wind information comprising the determined components of the wind and the relative position of said portion of said crane device and said wind provided by the system for determining and providing information to an operator of the crane device.

2. The crane device of claim 1, wherein said second component of the wind includes the direction of the wind, said second detector apparatus includes a wind direction detector for detecting the direction of the wind proximal to the crane device, and said portion of said crane device includes a boom.

3. The crane device of claim 2, wherein said first detector apparatus includes a wind speed detector and said first component of the wind includes a speed of wind proximal to the crane device.

4. A crane device, comprising:

a boom;

system for determining wind direction proximal to the crane device relative to a direction of said boom, said system comprising at least one wind sensor including a wind direction detector for detecting a direction of wind proximal to the crane device, and an apparatus that determines the direction of said boom relative to the determined direction of the wind proximal the crane device; and a display system including a display for displaying wind information including the direction of the wind relative to the direction of the boom provided by the determining system to an operator of the crane device.

5. The crane device of claim 4, wherein the determining system further comprises a wind speed detector for detecting a speed of the wind proximal to the crane device.

6. The crane device of claim 1, wherein said first detector apparatus includes a wind speed detector and said first component of the wind includes a speed of the wind proximal to the crane device.

7. The crane device of claim 1, wherein the display system includes a control console for controlling operation of the crane device in response to wind information provided by the system for determining and providing information.

8. The crane device of claim 7, wherein the display system:

generates a decision network for controlling operation of the crane device;

receives input data from a crane device operator regarding selected nodes of the network; and configures the crane device according to the input data.

9. The crane device of claim 8, wherein the display system displays data for two or more nodes of the network simultaneously.

10. The crane device of claim 8, wherein the display system displays data for a node of the network in response to a display request from the crane device operator.

11. The crane device of claim 1, wherein the display system automatically controls operation of the crane device in response to wind information provided by the system for determining and providing information.

12. The crane device of claim 1 wherein said system for determining and providing information can determine the wind load on said crane device; and wherein said display system can display said wind load to the operator of said crane device.

13. The crane device of claim 4 wherein said system for determining wind direction can determine the wind load on said crane device; and wherein said display system can display said wind load to the operator of said crane device.

* * * * *